US011304513B1

(12) United States Patent
Moore

(10) Patent No.: US 11,304,513 B1
(45) Date of Patent: Apr. 19, 2022

(54) RACK APPARATUSES

(71) Applicant: Jacob Leslie Moore, Spokane Valley, WA (US)

(72) Inventor: Jacob Leslie Moore, Spokane Valley, WA (US)

( * ) Notice: Subject to any disclaimer, the term of this patent is extended or adjusted under 35 U.S.C. 154(b) by 0 days.

(21) Appl. No.: 17/332,781

(22) Filed: May 27, 2021

(51) Int. Cl.
*A47B 43/00* (2006.01)
*A47F 5/10* (2006.01)

(52) U.S. Cl.
CPC ..... *A47B 43/00* (2013.01); *A47F 5/10* (2013.01)

(58) Field of Classification Search
CPC ..... A47B 43/00; A47F 5/10
See application file for complete search history.

(56) References Cited

U.S. PATENT DOCUMENTS 4,112,604 A * 9/1978 Ott ..... G09F 15/0056 40/605
4,727,994 A * 3/1988 Beaulieu ..... A47B 19/06 16/333
4,926,294 A * 5/1990 Beaulieu ..... A47F 11/10 248/240.4
5,078,284 A * 1/1992 Pirkl ..... A47F 5/105 211/195
6,000,663 A * 12/1999 Plasse ..... A01G 5/02 248/27.8
6,073,783 A * 6/2000 Allman ..... D06F 59/02 211/85.3
7,237,687 B1 * 7/2007 Abdi ..... A47G 25/0685 211/119.004
8,100,306 B2 * 1/2012 Gerhardt ..... B60R 9/045 224/320
8,469,206 B2 * 6/2013 Wilson ..... A01M 31/02 211/100
8,479,928 B2 * 7/2013 Tanabe ..... A47B 43/00 211/64
9,051,680 B1 * 6/2015 Harris ..... D06F 53/045
9,085,441 B2 * 7/2015 Mullins ..... E04G 21/26
9,370,277 B2 * 6/2016 Weaver ..... A47J 37/0786
10,118,678 B2 * 11/2018 Dias ..... B63B 32/83
11,008,164 B2 * 5/2021 Liu ..... A47B 47/028
2002/0109441 A1 * 8/2002 Wang ..... A47B 43/00 312/258
2010/0155346 A1 * 6/2010 Cheng ..... A47B 43/00 211/13.1
2010/0200525 A1 * 8/2010 Keyvanloo ..... A47F 5/10 211/59.2

(Continued)

*Primary Examiner* — Kimberley S Wright
(74) *Attorney, Agent, or Firm* — Lee & Hayes, P.C.

(57) ABSTRACT

A rack apparatus includes a top member and a bottom member. A first extension arm is pivotably attached to the bottom member and a second extension arm is pivotably attached to the bottom member. A first linkage arm is pivotably attached to the top member and slideably attached to the first extension arm, and a second linkage arm is pivotably attached to the top member and slideably attached to the second extension arm. The rack apparatus is displaceable between a stowed position and a use position via linear displacement of the bottom member. When in the stowed position, the first and second extension arms are positioned alongside the top and bottom members, and when in the use position, the first and second extension arms extend away from the bottom member.

20 Claims, 21 Drawing Sheets

(56) References Cited

U.S. PATENT DOCUMENTS

2010/0326938 A1* 12/2010 Zhu ..... A47F 5/10
211/149
2011/0174754 A1* 7/2011 Entz ..... A63B 71/0045
211/202
2014/0014607 A1* 1/2014 Mikich ..... A47B 96/027
211/195
2020/0369469 A1* 11/2020 Liu ..... A47F 5/10

* cited by examiner

RACK APPARATUSES

BACKGROUND

Utilizing a rack in a confined space may be difficult and time consuming. This is particularly true where obstructions in a confined space prevent access to a rack when attempting to hang articles (e.g., clothing, safety gear, recreational equipment, etc.) on the rack disposed in the confined space. For example, vehicles, boats, motorcycles etc. may be positioned adjacent to each other in a garage, a stowage facility, a container, a dock system, etc., and such objects may hinder or prevent users from hanging articles on racks, having a rigid frame, in the confined space. Moreover, the rack itself may become an obstacle to movement when it is not in use, as well.

Accordingly, there remains a need in the art for a rack that has a compact moveable frame, and allows a user to hang articles in a confined space.

SUMMARY

Generally, a rack apparatus according to this disclosure is configured to hang one or more articles. The rack apparatus is particularly suited for hanging one or more articles in confined spaces. In some instances, the rack apparatuses are displaceable between a stowed position and a use position. When the rack apparatus is in the stowed position, extension arms may be positioned alongside a top member and alongside a bottom member for storing the rack apparatus adjacent to a vertical surface until a time of use. Moreover, when the rack apparatus is in the use position, the extension arms may extend out at an angle away from the bottom member for hanging one or more articles at a time of use. This summary is provided to introduce simplified concepts of rack apparatuses, which are further described below in the Detailed Description. This summary is not intended to identify essential features of the claimed subject matter, nor is it intended for use in determining the scope of the claimed subject matter.

In an embodiment, a rack apparatus includes a top member extending between a first end of the top member opposite a second end of the top member, and a bottom member extending between a first end of the bottom member opposite a second end of the bottom member. The bottom member may be separated a distance below the top member. A first top end bracket may be fixed to the first end of the top member and a second top end bracket may be fixed to the second end of the top member. A first bottom end bracket may be fixed to the first end of the bottom member and a second bottom end bracket may be fixed to the second end of the bottom member. A first extension arm may have an end pivotably attached to the first bottom end bracket, and a second extension arm may have an end pivotably attached to the second bottom end bracket. A first linkage arm may have a first end pivotably attached to the first top end bracket and a second end slideably attached to the first extension arm. A second linkage arm may have a first end pivotably attached to the second top end bracket and a second end slideably attached to the second extension arm.

In another embodiment, a rack apparatus includes a top member, a bottom member, and a middle member. The middle member may extend between a first end of the middle member opposite a second end of the middle member and may have a front surface in an x-y dimensional plane. A width of the front surface may define the x dimensional direction and a length of the front surface may define the y dimensional direction. The front surface of the middle member may span a gap between the top member and the bottom member. When the rack apparatus is displaced into the use position, the middle member may be displaced in at least the x dimensional direction and a z dimensional direction perpendicular to the x dimensional direction and the y dimensional direction such that the front surface of the middle member covers the top member and the bottom member.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to a rack apparatus that is displaceable between a stowed position and a use position via linearly displacing a bottom member. The displacement occurs such that, when the rack apparatus is displaced into the use position, the bottom member is linearly displaced a distance toward a top member and when the rack apparatus is displaced into the stowed position the bottom member may be linearly displaced the distance away from the top member. When the rack apparatus is in the stowed position, extension arms may be positioned alongside the top member and alongside the bottom member, which provides for storing the rack apparatus adjacent to a vertical surface until a time of use. Moreover, because the rack apparatuses are displaceable to the stowed position where the extension arms may be positioned alongside the top member and alongside the bottom member, the rack apparatuses may be relatively more compact than existing rigid framed racks, which remain in an extended position constantly. Thus, the ability to reduce the footprint of the rack apparatus when not in use, reduces an amount of space required for storing the rack apparatuses and reduces a cost associated with requiring more space for other items such as vehicles, boats, motorcycles, etc.

While this application describes various embodiments of rack apparatuses used in confined spaces to hang articles, this is by way of example and not limitation. For example, the rack apparatuses may be used in other fields such as in a marine environment to hold boards (e.g., surf boards, paddle boards, water skies, hydrofoils; in a mountain resort environment as to hang articles such as snow skies, snowboards, etc.; in a retail environment as a display rack to display items for sale; etc.). Further, while this application describes rack apparatuses that are displaceable between a stowed position and a use position via linearly displacing the bottom member, the rack apparatuses may be displaceable between a stowed position and a use position via linearly displacing the middle member, and/or linearly displacing the top member.

Notably, all dimensions described herein, may vary depending on the overall size of the rack apparatus, which may vary in size according to a size and/or weight of an article, item, etc. the rack apparatus is to hang and/or hold. Nevertheless, some specific dimensions of components are mentioned herein as examples and relate to about a 26 inch wide rack apparatus example.

Illustrative Rack Apparatuses

Figure 1:
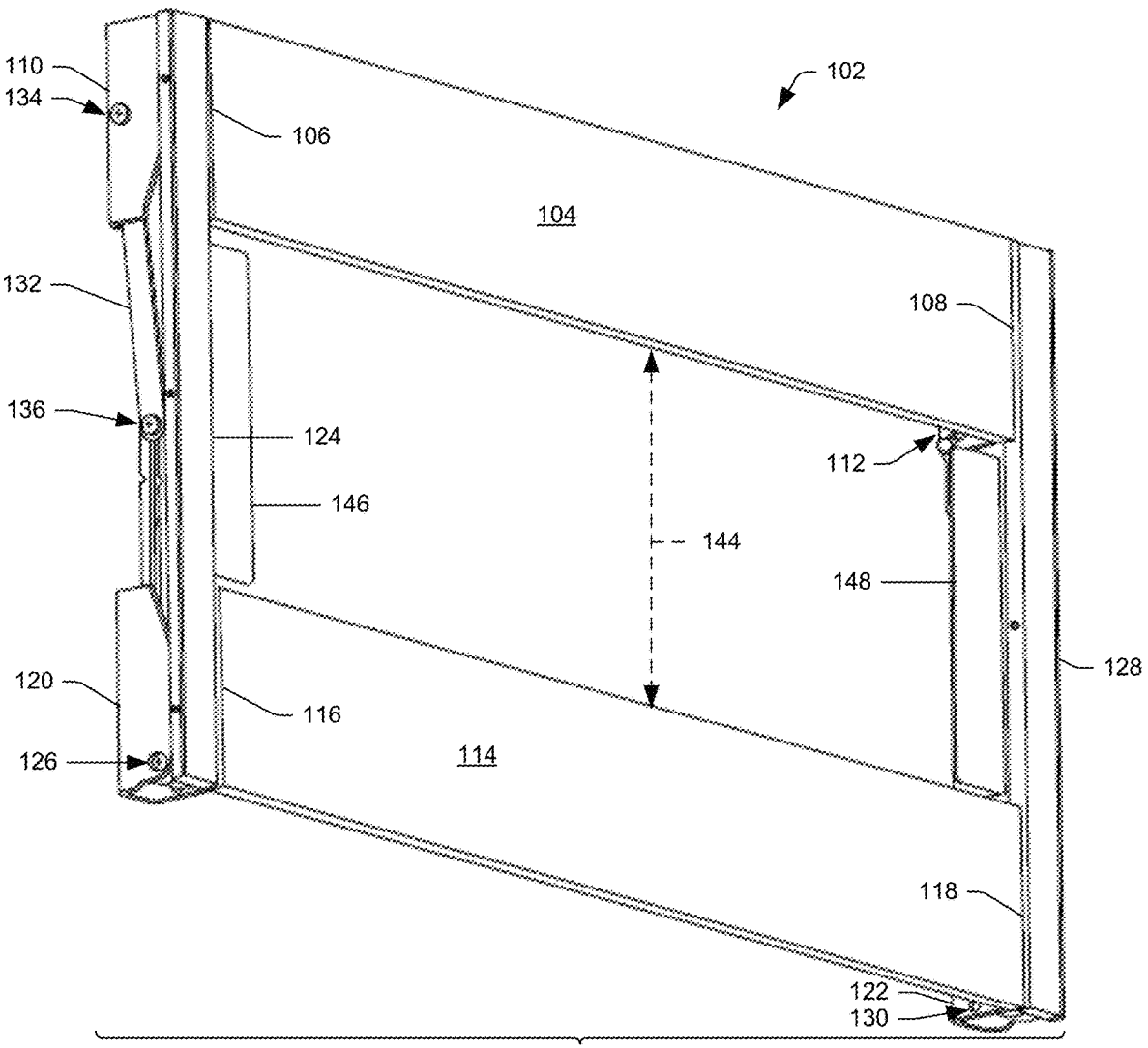
FIG. 1 illustrates a front perspective view of an example rack apparatus in a stowed position, according to an embodiment in this disclosure.

FIG. 1 illustrates a front perspective view 100 of an example rack apparatus 102 in a stowed position, according to an embodiment in this disclosure. The rack apparatus 102 may be used in confined spaces to hang the one or more articles. For example, the rack apparatus 102 may be used in a confined space including obstructions that reduce access to the rack apparatus 102 when a user attempts to hang articles (e.g., clothing, safety gear, recreational equipment, etc.), for example, for temporary drying of wet objects/articles/equipment. Moreover, where the impact on the space is not an inconvenience, the rack apparatus 102, of course, may be left to hang articles for an extended time period as a means of storage off the floor. For example, vehicles, boats, motorcycles, etc. may be positioned adjacent to each other in a garage, a stowage facility, a container, a dock system, etc. As indicated above, vehicles, boats, motorcycles, etc. may reduce a user's access and/or available space when hanging articles in the confined space. Thus, the rack apparatus 102 may be particularly well-suited for hanging articles in the confined space via being displaceable between a stowed position (illustrated in FIGS. 1 and 2) and a use position (illustrated in FIGS. 3 and 4).

Figure 2:
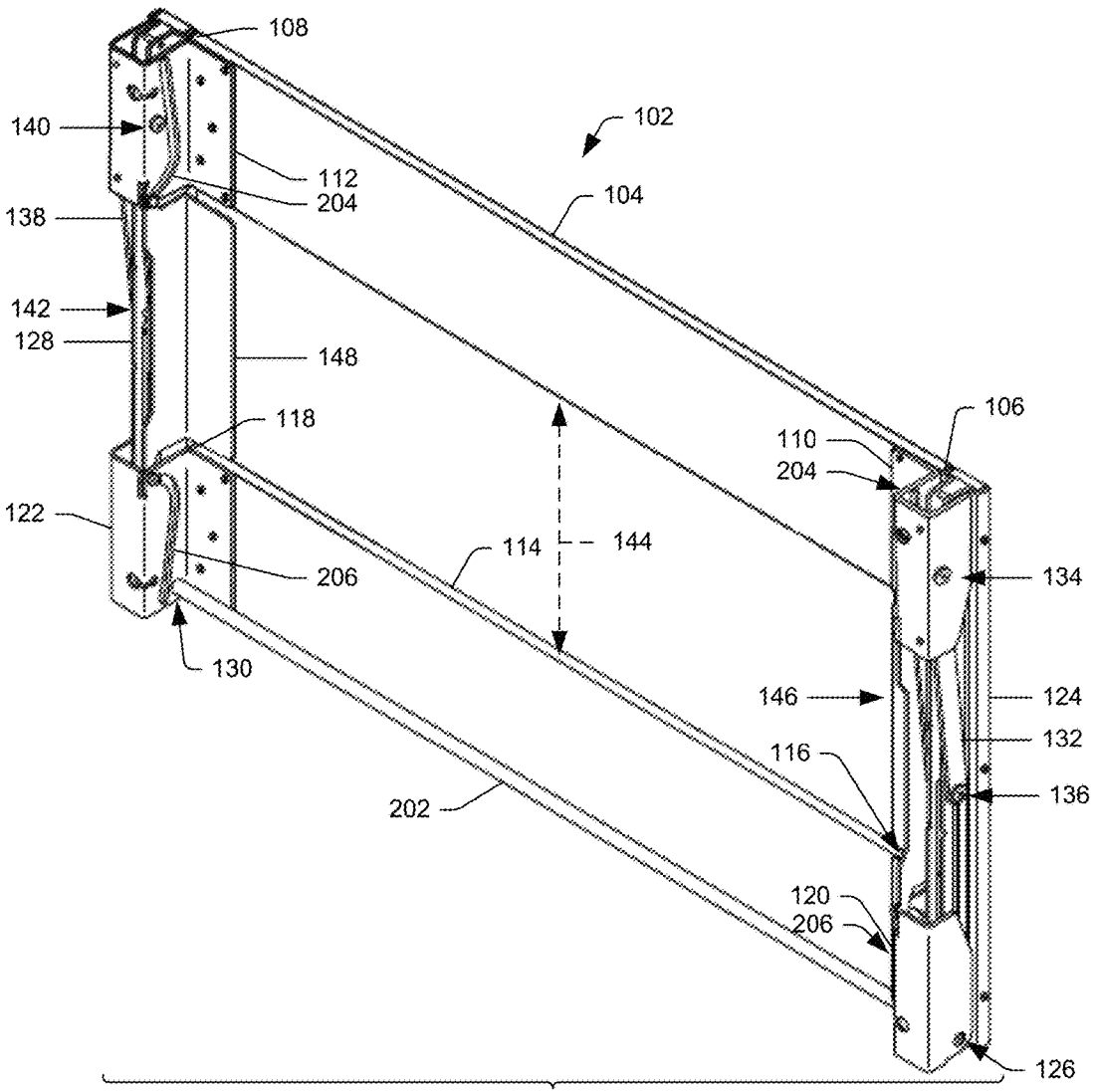
FIG. 2 illustrates a back perspective view of the rack apparatus in a stowed position, according to an embodiment in this disclosure.

FIG. 2 illustrates a back perspective view 200 of the rack apparatus 102 in a stowed position, according to an embodiment in this disclosure. FIGS. 1 and 2 illustrate the rack apparatus 102 may include a top member 104 extending between a first end 106 of the top member 104 opposite a second end 108 of the top member 104. A first top end bracket 110 may be fixed to the first end 106 of the top member 104. A second top end bracket 112 may be fixed to the second end 108 of the top member 104. In one embodiment, the first top end bracket 110 and the second top end bracket 112 may be fixed to the first end 106 and the second end 108 of the top member via fasteners (e.g., screws, rivets, bolts, etc.). In an alternative embodiment not shown, the first top end bracket 110 and the second top end bracket 112 may instead be integral with the first end 106 and the second end 108. For example, the first top end bracket 110 and the second top end bracket 112 may be integrally formed with the top member 104, such as a single unit of material that is bent, blown, injected, etc. to have the shape and structure as shown, e.g., a sheet metal, a plastic, or a composite like fiberglass, carbon fiber, etc.

In an embodiment, the top member 104 may be formed of wood, plastic, metal, etc. The first top end bracket 110 and the second top end bracket 112 may be formed of a metal to provide increased strength and durability. However, it is contemplated that other materials, such as wood, plastic, or a composite may be sufficient. The first top end bracket 110 and/or the second top end bracket 112 are attachable to a vertical surface, such as a wall or a post, (not shown) to fix the rack apparatus 102 to the vertical surface. For example, the first top end bracket 110 and/or the second top end bracket 112 may be attached to a wall (e.g., a garage wall, a stowed facility wall, a shed wall, etc.) via any sufficient fastener that one skilled in the art would recognize as capable of supporting an expected load on the rack apparatus 102 (e.g., screws, rivets, bolts, adhesive, an adhesive tape, hook and loop tape, etc.

FIGS. 1 and 2 illustrate the rack apparatus 102 may further include a bottom member 114 extending between a first end 116 of the bottom member 114 opposite a second end 118 of the bottom member 114. A first bottom end bracket 120 may be fixed to the first end 116 of the bottom member 114 via fasteners as discussed above. A second bottom end bracket 122 may be fixed to the second end 118 of the bottom member 114 via fasteners as discussed above. Similar to the possible embodiments of the top member 104, the first bottom end bracket 120 and the second bottom end bracket 122 may be integrally formed with the bottom member 114. Likewise, the selection of the materials of the bottom member 114, the first bottom end bracket 120, and/or the second bottom end bracket 122 may be similar or the same as those discussed above.

FIGS. 1 and 2 illustrate the rack apparatus 102 may include a first extension arm 124 having an end 126 pivotably attached to the first bottom end bracket 120. The rack apparatus 102 may include a second extension arm 128 having an end 130 pivotably attached to the second bottom end bracket 122. The first extension arm 124 and the second extension arm 128 may have the same structure. The first extension arm 124 and the second extension arm 128 may be formed of metal, plastic, composite, etc.

FIGS. 1 and 2 illustrate a first linkage arm 132 may have a first end 134 pivotably attached to the first top end bracket 110 and a second end 136 slideably attached to the first extension arm 124. The rack apparatus 102 may include a second linkage arm 138 that may have a first end 140 pivotably attached to the second top end bracket 112 and a second end 142 slideably attached to the second extension arm 128. The first linkage arm 132 and the second linkage arm 138 have the same structure. The first linkage arm 132 and the second linkage arm 138 may be formed of metal, plastic, composite, etc.

FIGS. 1 and 2 illustrate the bottom member 114 may be separated a distance 144 below the top member 104. The bottom member 114 separated by the distance 144 below the top member 104 may define a gap between the top member 104 and the bottom member 114. The rack apparatus 102 may be displaceable between the stowed position (illustrated in FIGS. 1 and 2) and the use position (illustrated in FIGS. 3 and 4) via linearly displacing the bottom member 114, such that, when the rack apparatus 102 is displaced into the use position, the bottom member 114 is linearly displaced by the distance 144 toward the top member 104 and when the rack apparatus 102 is displaced into the stowed position the bottom member 114 is linearly displaced by the distance 144 away from the top member 104.

As FIGS. 1 and 2 illustrate, when the rack apparatus 102 is in the stowed position, the first extension arm 124 may be positioned alongside the first end 106 of the top member 104 and alongside the first end 116 of the bottom member 114, and the second extension arm 128 may be positioned alongside the second end 108 of the top member 104 and alongside the second end 118 of the bottom member 114 for storing the rack apparatus 102 adjacent to a vertical surface (not shown) until a time of use.

FIG. 2 illustrates the rack apparatus may include an axle 202. The axle 202 may have a first end attached to the end 126 of the first extension arm 124 and a second end attached to the end 130 of the second extension arm 128. The axle 202 may force the first extension arm 124 and the second extension arm 128 to pivotably displace together when the rack apparatus 102 is displaced between the stowed position and a use position. For example, the axle 202 may force the first extension arm 124 and the second extension arm 128 to pivotably displace together when the bottom member 144 is linearly displaced the distance 144 between the stowed position and the use position.

FIGS. 1 and 2 illustrates rack apparatus may include a first brace member 146 and a second brace member 148. The first brace member 146 and the second brace member 148 may have the same structure. A first end of the first brace member 146 may be slideably attached to a track 204 of the first top end bracket 110, and a second end of the first brace member 146 may be slideably attached to a track 206 of the first bottom end bracket 120. Similarly, a first end of the second brace member 148 may be slideably attached to the track 204 of the second top end bracket 112, and a second end of the second brace member 148 may be slideably attached to the track 206 of the second bottom end bracket 122. The tracks 204 of the first and second top end brackets 110 and 112 and the tracks 206 of the first and second bottom end brackets 120 and 122 may provide for linearly displacing the bottom member 114. For example, when the rack apparatus 102 is displaced between the stowed position and the use position via linearly displacing the bottom member 114, the bottom member 114 forces the first end of the first brace member 146 to slideably displace along the track 204 of the first top end bracket 110 and the second end of the first brace member 146 to slideably displace along the track 206 of the first bottom end bracket 120, and forces the first end of the second brace member 148 to slideably displace along the track 204 of the second top end bracket 112 and the second end of the second brace member 148 to slideably displace along the track 206 of the second bottom end bracket 122.

Figure 3:
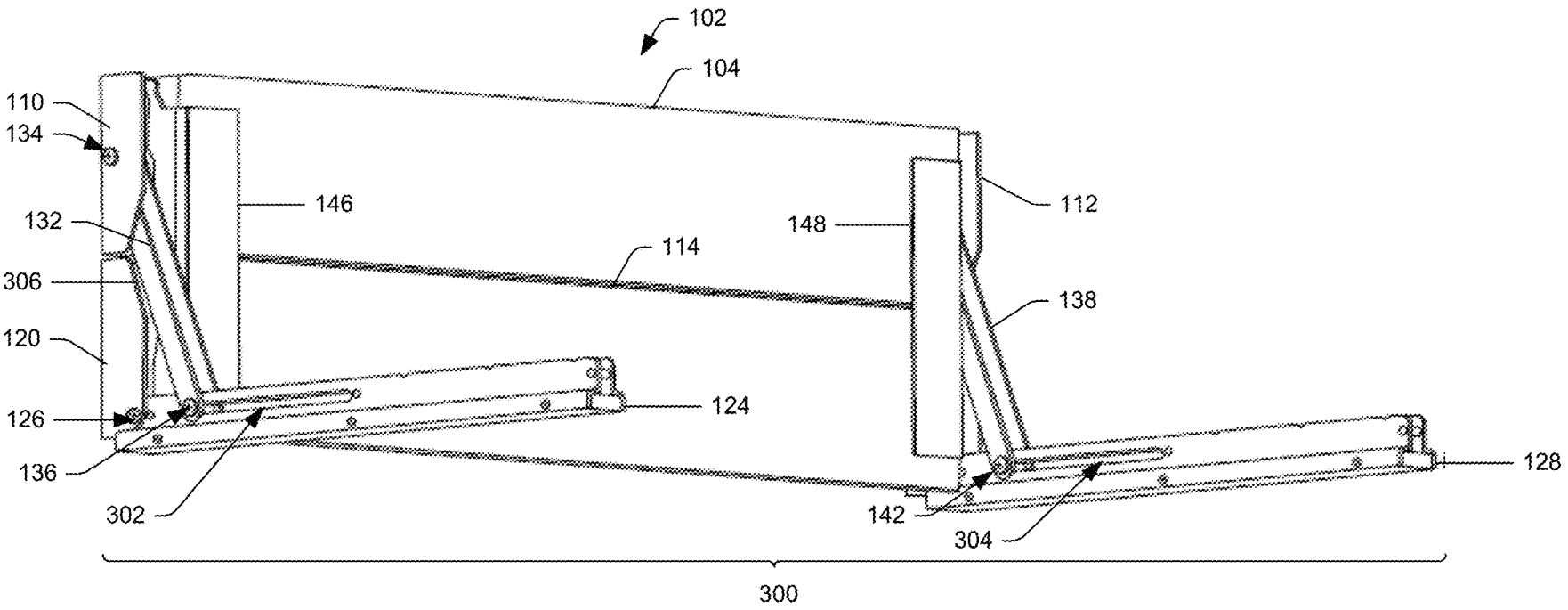
FIG. 3 illustrates a front perspective view of the rack apparatus in a use position, according to an embodiment in this disclosure.

FIG. 3 illustrates a front perspective view 300 of the rack apparatus 102 in a use position, according to an embodiment in this disclosure. FIG. 3 illustrates that when the rack apparatus 102 is in the use position, the first extension arm 124 extends at an angle away from the bottom member 114 and the second extension arm 128 extends at an angle away from the bottom member for hanging at least one article of the one or more articles at the time of use.

FIG. 3 illustrates the second end 136 of the first linkage arm 132 may be slideably arranged in a slot 302 disposed in the first extension arm 124. Similarly, the second end 142 of the second linkage arm 138 may be slideably arranged in a slot 304 disposed in the second extension arm 128. The slot 302 disposed in the first extension arm 124 may be the same as the slot 304 disposed in the second extension arm 128.

Figure 4:
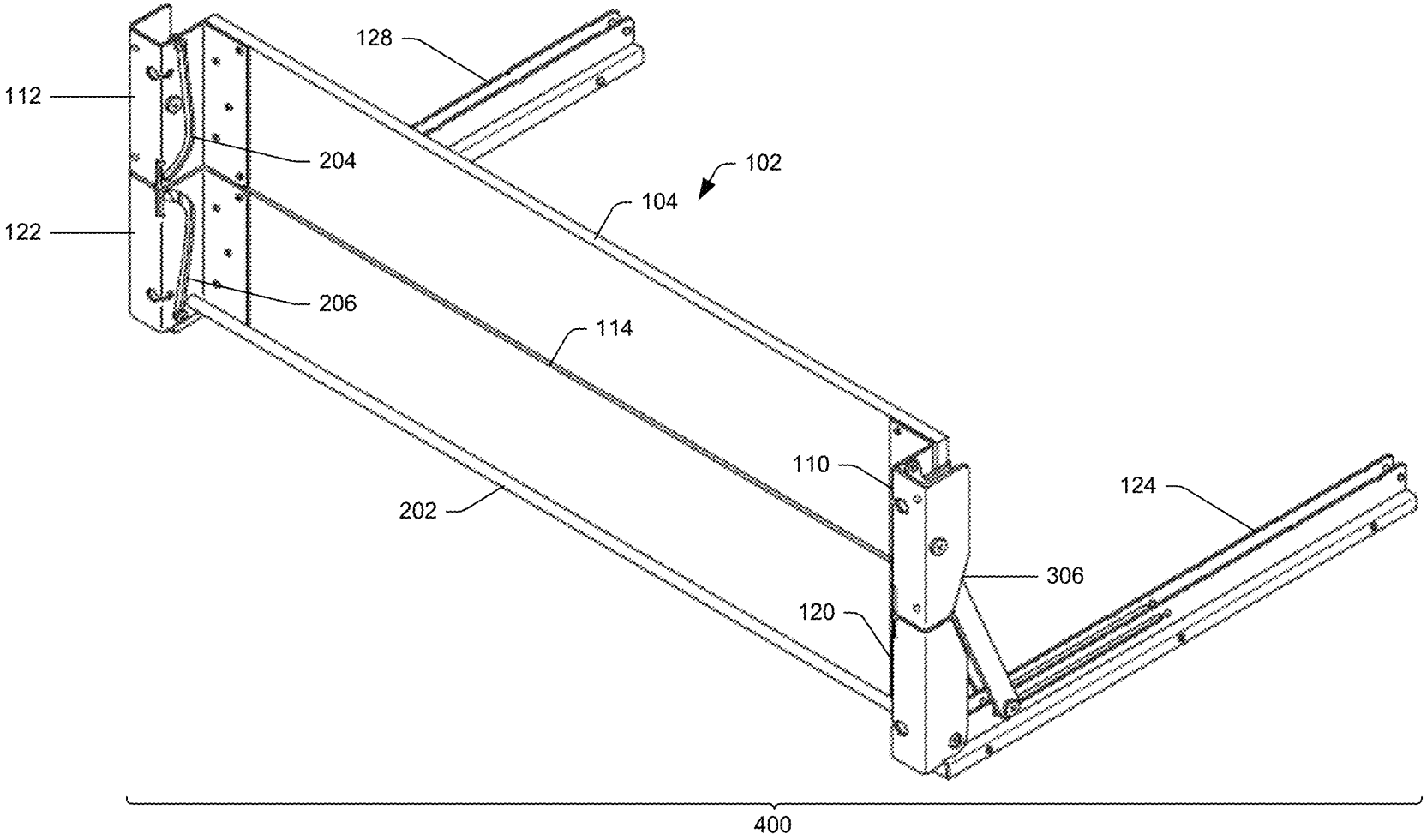
FIG. 4 illustrates a back perspective view of the rack apparatus in a use position, according to an embodiment in this disclosure.

FIG. 4 illustrates a back perspective view 400 of the rack apparatus 102 in a use position, according to an embodiment in this disclosure. FIGS. 3 and 4 illustrate the first bottom end bracket 120 and the second bottom end bracket 122 each may include a negatively sloped edge 306 on an outer side thereof. In an embodiment, the first bottom end bracket 120 and the second bottom end bracket 122 are disposed such that, upon moving the apparatus 102 into the use condition, at least a portion of the first linkage arm 132 makes contact with the respective negatively sloped edge 306 and at least a portion of the second linkage arm 138 makes contact with the respective negatively sloped edge 306. Thus, when the first linkage arm 132 and the second linkage arm 138 each contact the respective negatively sloped edge 306, the first extension arm 124 and the second extension arm 128 are forced to extend out away from the bottom member 114 to be positioned to allow hanging an article.

Figure 5:
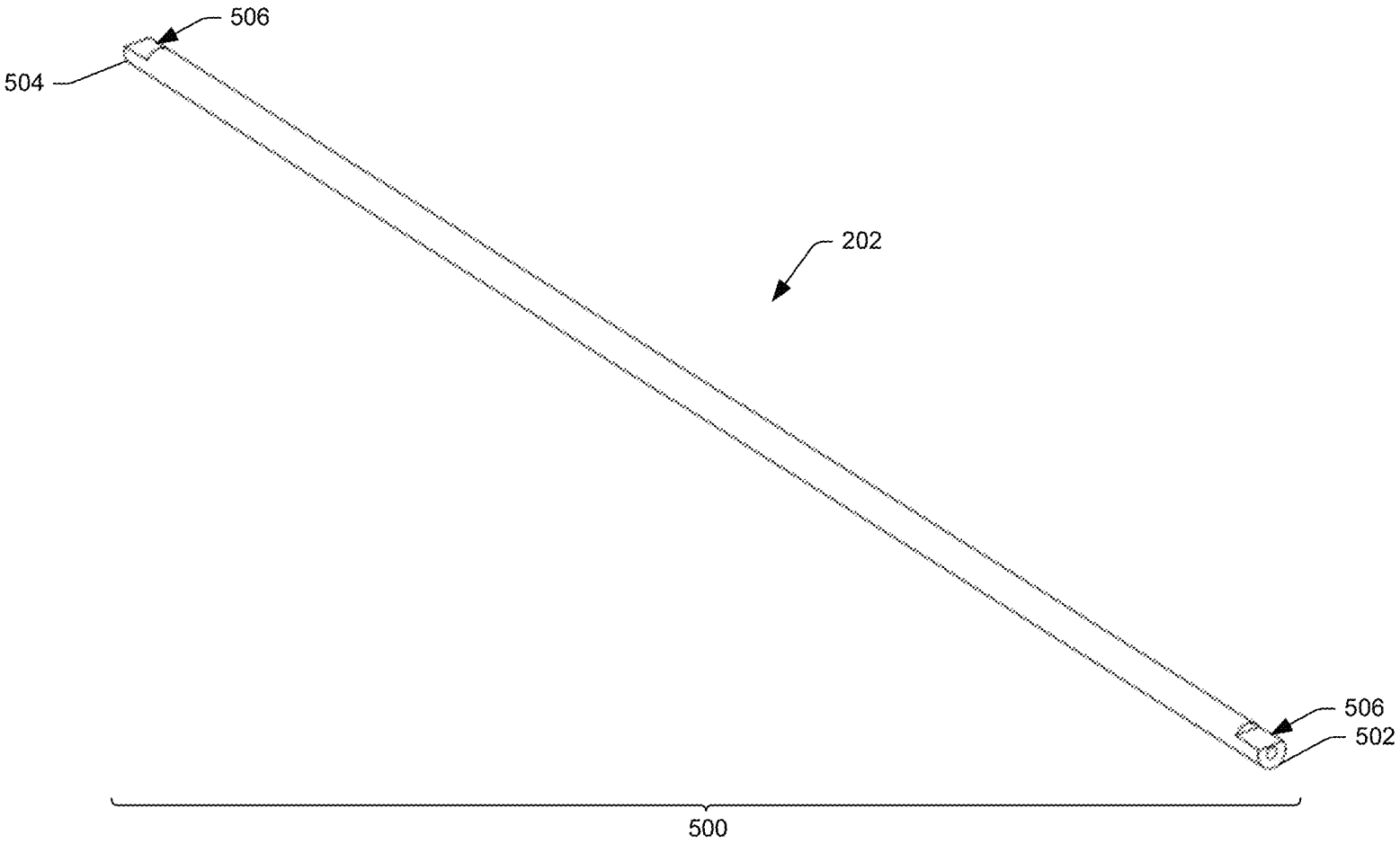
FIG. 5 illustrates a perspective view of an axle, according to an embodiment in this disclosure.

FIG. 5 illustrates a perspective view 500 of the axle 202, according to an embodiment in this disclosure. The axle 202 extends between a first end 502 of the axle 202 opposite a second end 504 of the axle 202. As discussed above with regard to FIG. 2, the first end 502 of the axle 202 may be attached to the end 126 of the first extension arm 124 and the second end 504 may be attached to the end 130 of the second extension arm 128. In an embodiment, each of the ends 502 and 504 of the axle 202 may include a keyed end 506 that is received by a cooperating hole disposed in each of the respective ends 126 and 130 of the first and second extension arms 124 and 128. While FIG. 5 illustrates the keyed ends 506 having a "D" cross-sectional profile, the keyed ends 506 may have a different shape. For example, the keyed ends 506 may have a groove (e.g., a keyway, a slot, a notch), a step down shape, a tapered shape, a threaded end, a tapped end, retaining ring grooves, etc. for attaching to the ends 126 and 130 of the first and second extension arms 124 and 126. The axle 202 may be formed of metal, plastic, composite, wood, etc.

Figure 6:
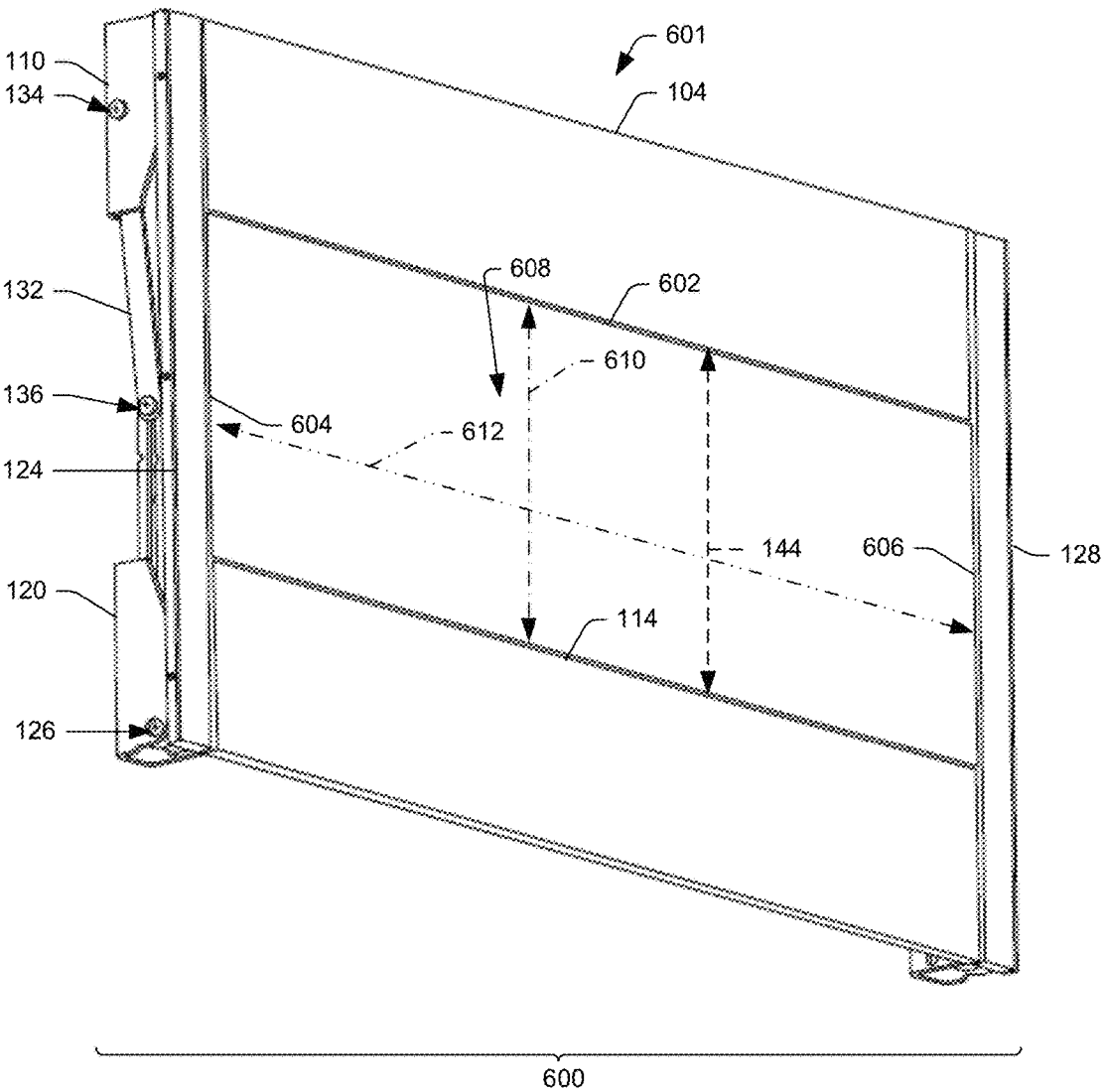
FIG. 6 illustrates a front perspective view of the rack apparatus including a middle member in the stowed position, according to an embodiment in this disclosure.

FIG. 6 illustrates a front perspective view 600 of an embodiment of a rack apparatus 601, similar to the rack apparatus 102 in FIG. 1. However, the apparatus 601 includes a middle member 602 in the stowed position, according to an embodiment in this disclosure. Inasmuch as other components of the apparatus 601 are similar to those of apparatus 102, the reference numbers remain the same on the same parts for convenience. The middle member 602 may extend between a first end 604 of the middle member 602 opposite a second end 606 of the middle member 602. The middle member 602 may have a front surface 608 in an x-y dimensional plane, where a width 610 of the front surface 608 defines the x dimensional direction and a length 612 of the front surface 608 defines the y dimensional direction. FIG. 6 illustrates the front surface 608 of the middle member 602 may span the gap, defined by the distance 144, between the top member 104 and the bottom member 114 when the rack apparatus 102 is in the stowed position.

Figure 7:
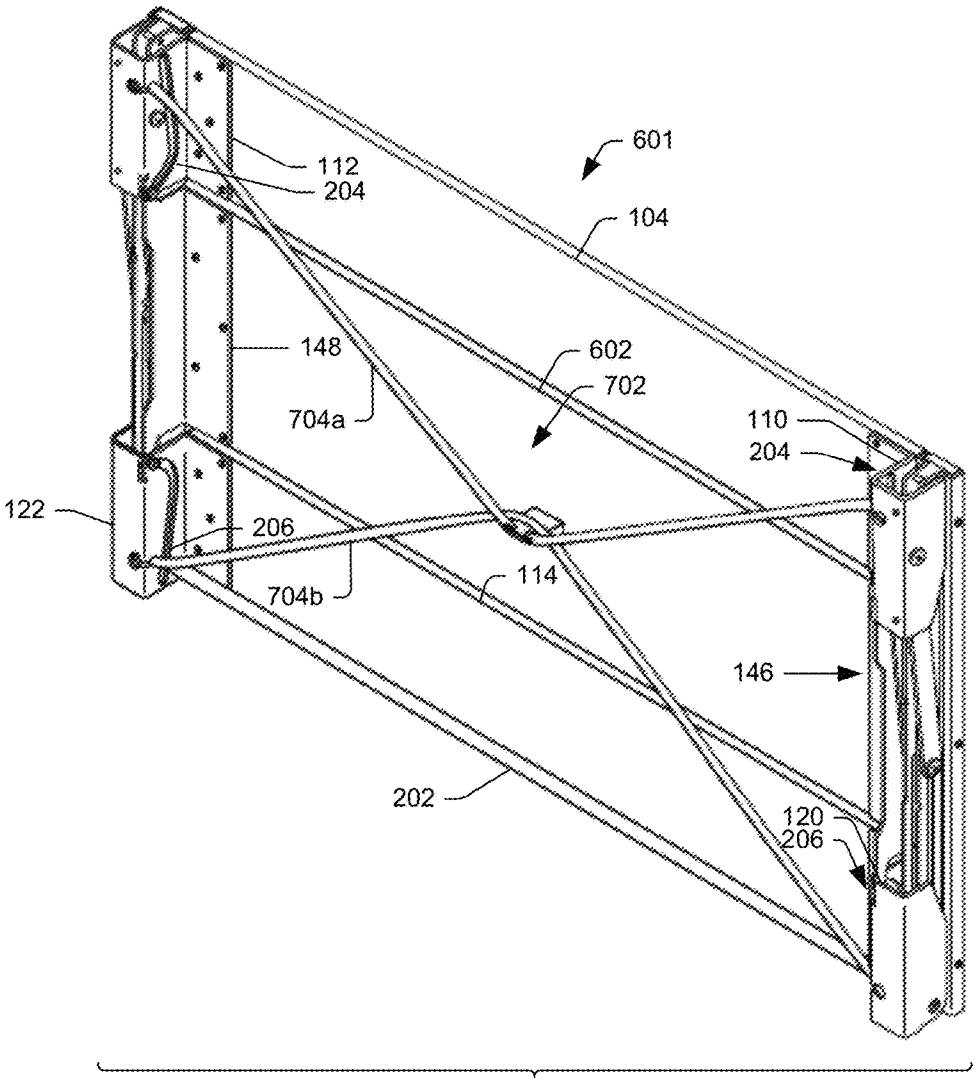
FIG. 7 illustrates a back perspective view of the rack apparatus including the middle member in the stowed position, according to an embodiment in this disclosure.

FIG. 7 illustrates a back perspective view 700 of the rack apparatus 102 including the middle member 602 in the stowed position, according to an embodiment in this disclosure. FIG. 7 illustrates a back surface 702 of the middle member 602 opposite the front surface 608 of the middle member 602 may be fixed to the first brace member 146, and the back surface 702 of the middle member 602 opposite the front surface 608 of the middle member 602 may be fixed to the second brace member 148. In an embodiment as depicted in FIG. 7, elastic cords 704*a*, 704*b* may be included with the rack apparatus 601. The elastic cords 704*a* and 704*b* may provide for assisting the displacement of the bottom member 114 and/or the middle member 602 when the rack apparatus 601 is displaced between a stowed position and a use position. The elastic cords 704*a* and 704*b* may be attached to the first top end bracket 110, the second top end bracket 112, first bottom end bracket 120, the second bottom end bracket 122. The elastic cords 704*a* and 704*b* may be wrapped to intersect each other. The elastic cords 704*a* and 704*b* may further be attached to the back surface 702 of the middle member 602. For example, the elastic cords 704*a* and 704*b* may further be attached to a fastening mechanism fixed to the back surface 702 of the middle member 602.

Figure 8:
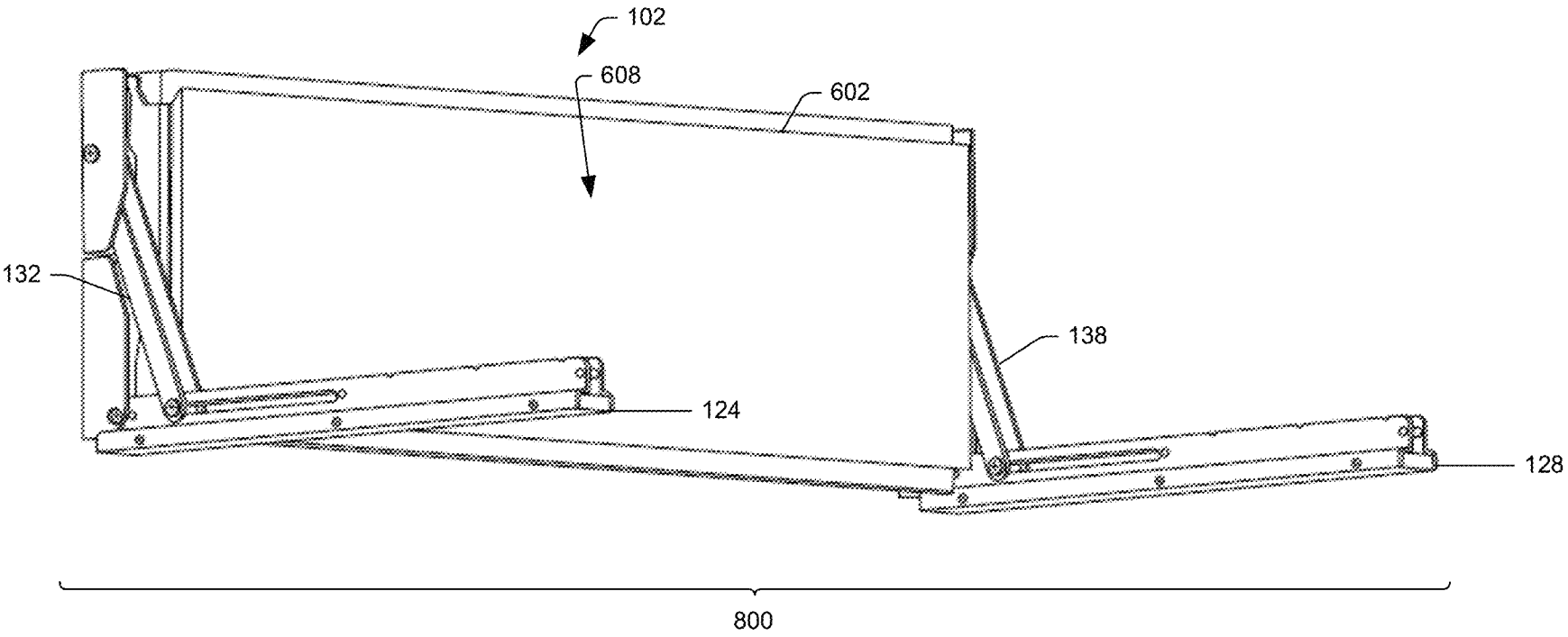
FIG. 8 illustrates a front perspective view of the rack apparatus including the middle member in the use position, according to an embodiment in this disclosure.

FIG. 8 illustrates a front perspective view 800 of the rack apparatus 601 including the middle member 602 in the use position, according to an embodiment in this disclosure. FIG. 8 illustrates when the rack apparatus 601 is displaced from the stowed position to the use position via linearly displacing the bottom member 114, the middle member 602 may be displaced at least in the x dimensional direction and in a z dimensional direction perpendicular to the x dimensional direction and the y dimensional direction such that the front surface 608 of the middle member 602 covers the top member 104 and the bottom member 114. For example, when the rack apparatus 601 is displaced between the stowed position and the use position via linearly displacing the bottom member 114, the bottom member 114 forces the first end of the first brace member 146 to slideably displace along the track 204 of the first top end bracket 110 and the second end of the first brace member 146 to slideably displace along the track 206 of the first bottom end bracket 120, and forces the first end of the second brace member 148 to slideably displace along the track 204 of the second top end bracket 112 and the second end of the second brace member 148 to slideably displace along the track 206 of the second bottom end bracket 122 to displace the middle member 602 in at least the x dimensional direction and a z dimensional direction perpendicular to the x dimensional direction and the y dimensional direction such that when the rack apparatus 601 is in the use position, the front surface 608 of the middle member 602 covers the top member 104 and the bottom member 114.

Figure 9:
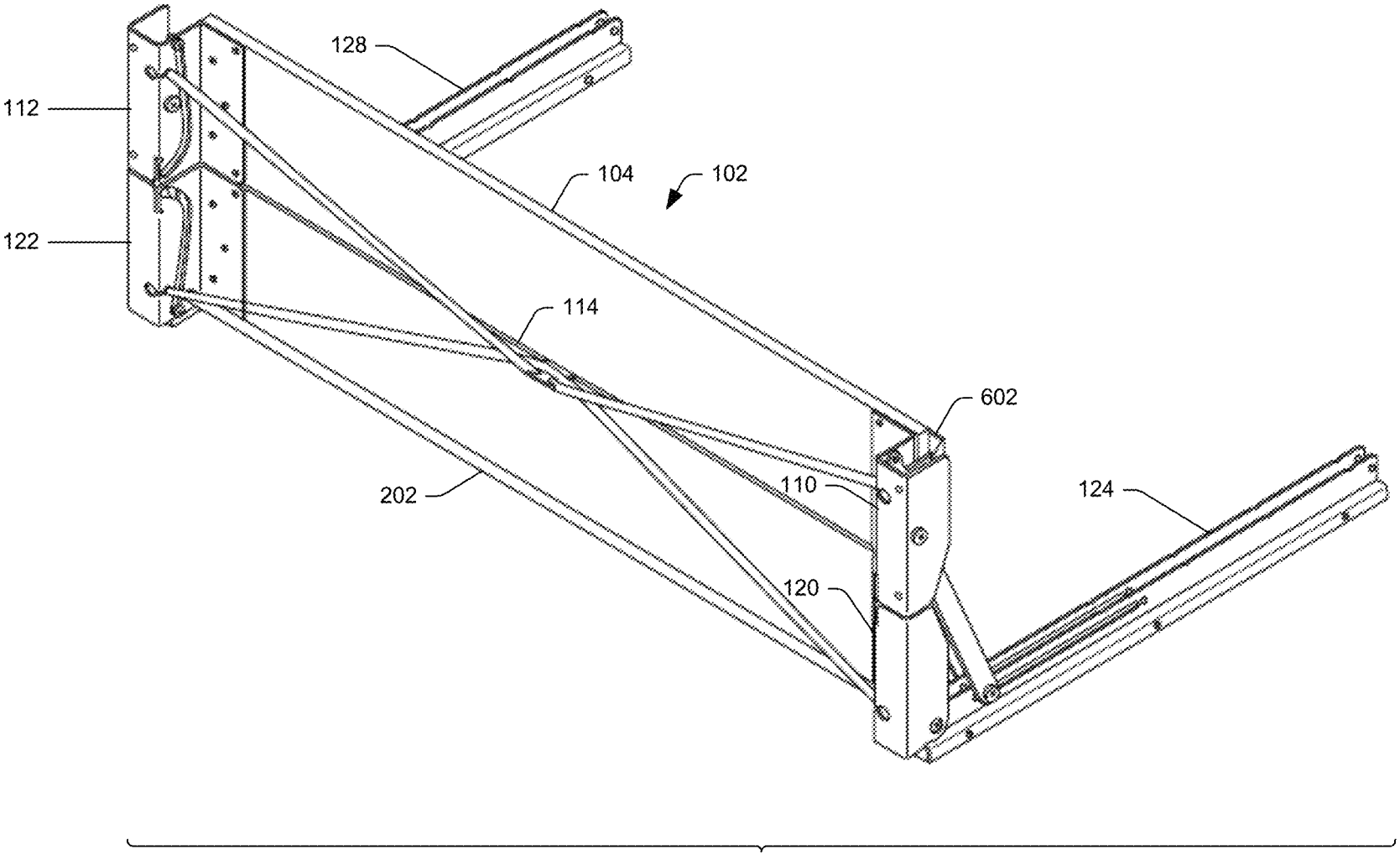
FIG. 9 illustrates a back perspective view of the rack apparatus including the middle member in the use position, according to an embodiment in this disclosure.

FIG. 9 illustrates a back perspective view 900 of the rack apparatus 601 including the middle member 602 in the use position, according to an embodiment in this disclosure. FIG. 9 illustrates the top member 104 and the bottom member 114 disposed behind the middle member 602. The middle member 602 may be formed of wood, plastic, metal, etc.

Figure 10:
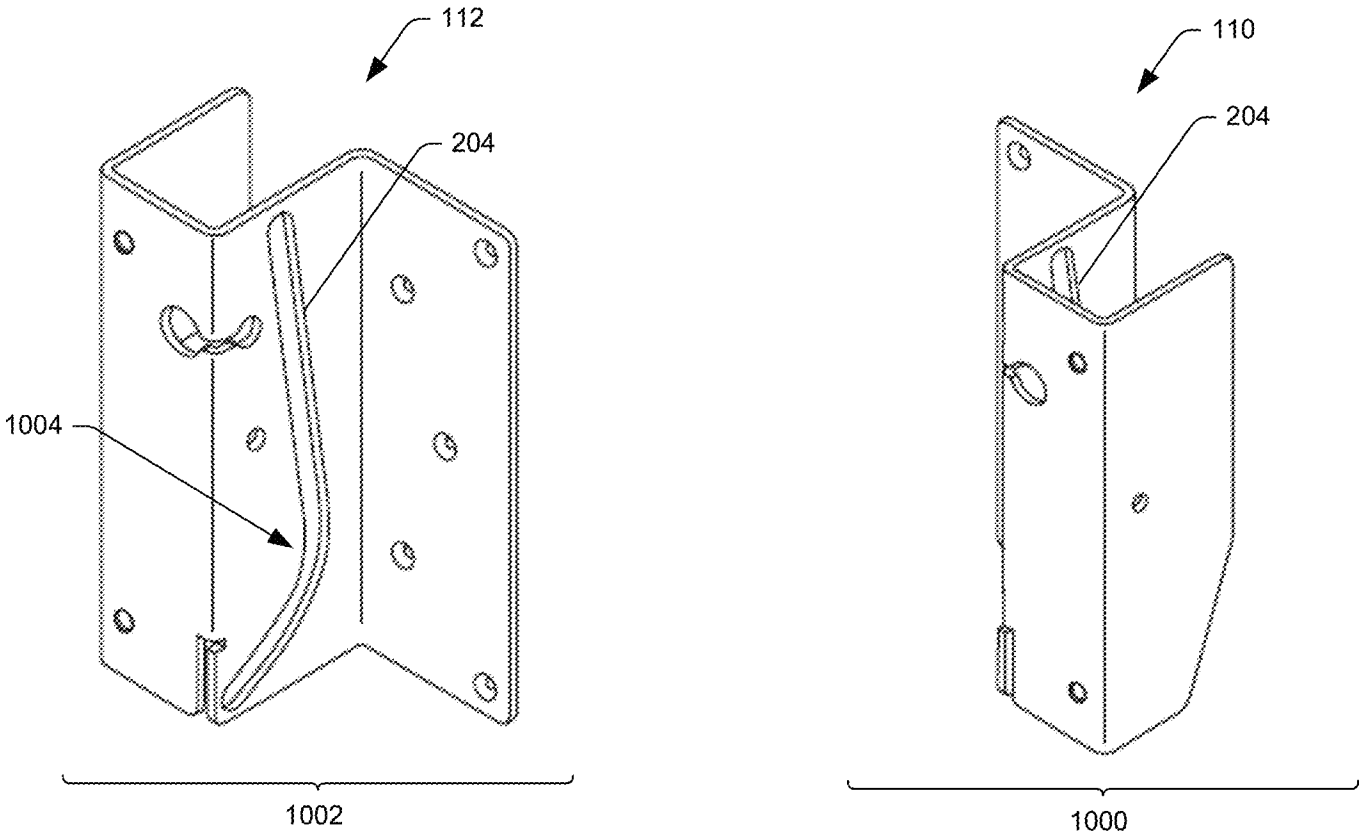
FIG. 10 illustrates a back perspective view of a first top end bracket and a back perspective view of a second top end bracket, according to an embodiment in this disclosure.

FIG. 10 illustrates a back perspective view 1000 of the first top end bracket 110 and a back perspective view 1002 of the second top end bracket 112, according to an embodiment in this disclosure. FIG. 10 illustrates the track 204 disposed in the first and second top end brackets 110 and 112. The track 204 may have an outward curve 1004 to force the brace members 146 and 148 and/or the middle member 602 in a path to prevent interference when being moved between the first position and the second position.

Figure 11:
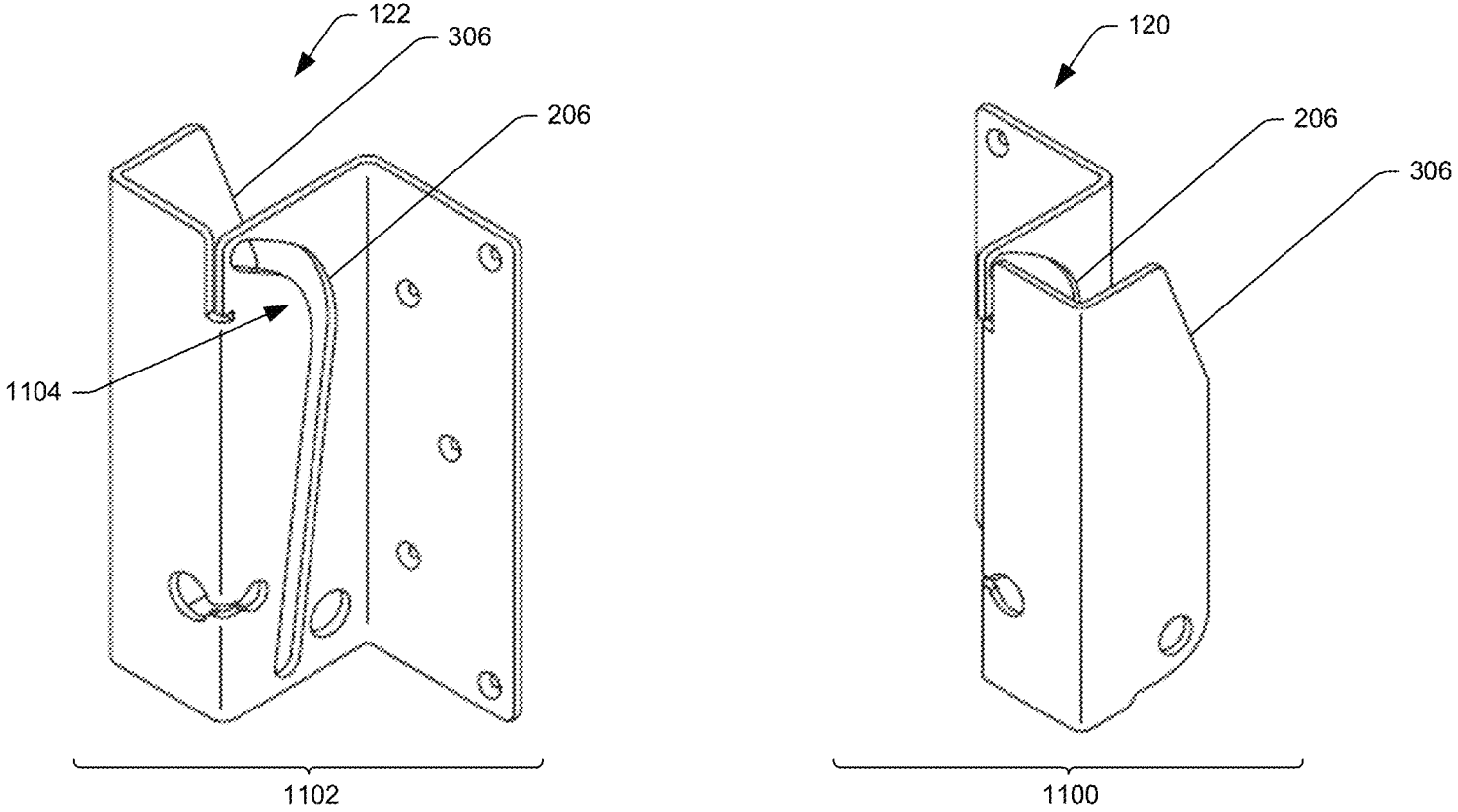
FIG. 11 illustrates a back perspective view of a first bottom end bracket and a back perspective view of a second bottom end bracket, according to an embodiment in this disclosure.

FIG. 11 illustrates a back perspective view 1100 of the first bottom end bracket 120 and a back perspective view 1102 of the second bottom end bracket 122, according to an embodiment in this disclosure. FIG. 11 illustrates the track 206 disposed in the first and second bottom end brackets 120 and 122.

Figure 12:
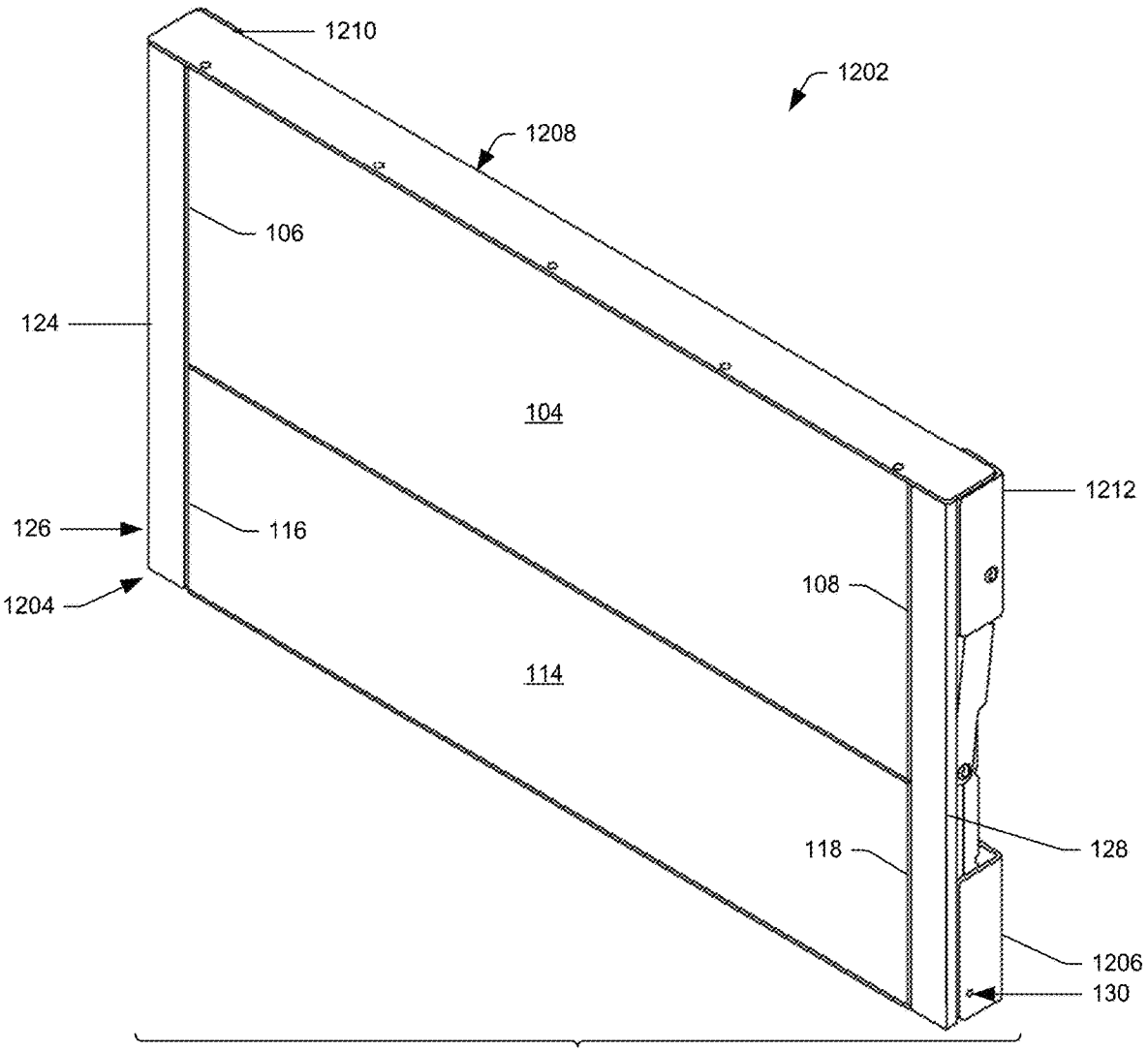
FIG. 12 illustrates a front perspective view of another example rack apparatus in a stowed position, according to an embodiment in this disclosure.

FIG. 12 illustrates a front perspective view 1200 of an embodiment of a rack apparatus 1202 similar to rack apparatuses 102 and 601 in the stowed position, according to an embodiment in this disclosure. However, the apparatus 1202 does not include a middle member 602 in the stowed position, according to an embodiment in this disclosure. Inasmuch as other components of the apparatus 1202 are similar to those of apparatuses 102 and 601, the reference numbers remain the same on the same parts for convenience.

Figure 13:
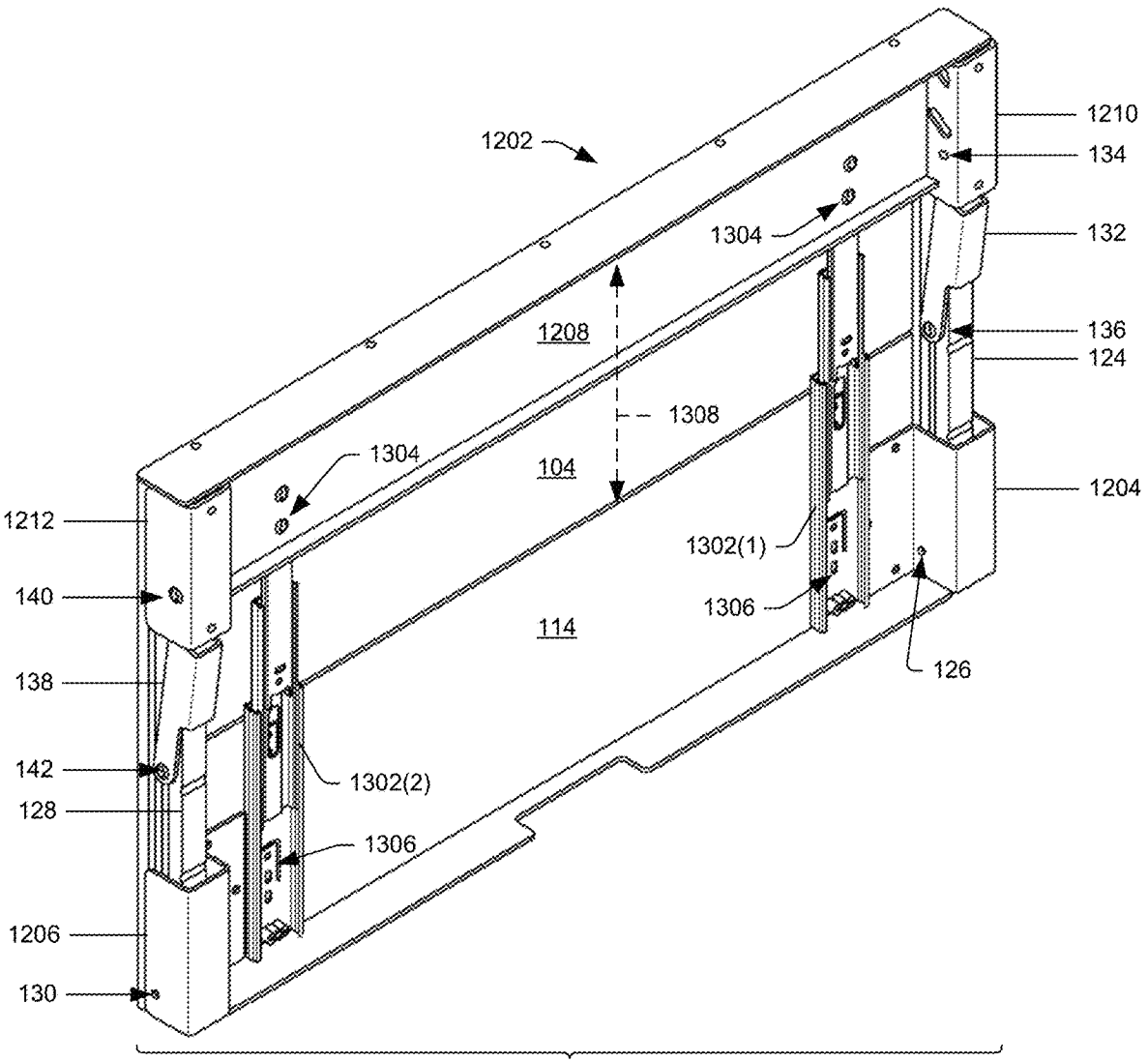
FIG. 13 illustrates a back perspective view of the other rack apparatus in a stowed position, according to an embodiment in this disclosure.

FIG. 13 illustrates a back perspective view 1300 of the rack apparatus 1202 in a stowed position, according to an embodiment in this disclosure. FIGS. 12 and 13 illustrate the rack apparatus 1202 may include the first extension arm 124 having the end 126 pivotably attached to a first bottom end bracket 1204. The rack apparatus 1202 may include the second extension arm 128 having an end 130 pivotably attached to a second bottom end bracket 1206.

FIGS. 12 and 13 illustrate a top bracket 1208 extending between a first end 1210 of the top bracket 1208 opposite a second end 1212 of the top bracket 1206. The top bracket 1206 being attachable to a vertical surface to fix the apparatus 1202 to the vertical surface. In an embodiment, the top bracket 1208 may be formed of wood, plastic, metal, etc. The first end 1210 of the top bracket 1208 and/or the second end 1212 of the top bracket 1208 are attachable to a vertical surface, such as a wall or a post, (not shown) to fix the rack apparatus 1202 to the vertical surface.

FIGS. 12 and 13 illustrate the first linkage arm 132 having the first end 134 pivotably attached to the first end 1210 of the top bracket 1208 and the second end 136 slideably attached to the first extension arm 124. FIGS. 12 and 13 illustrate the second linkage arm 138 having the first end 140 pivotably attached to the second end 1212 of the top bracket 1208 and the second end 142 slideably attached to the second extension arm 128.

FIG. 13 illustrates the rack apparatus 1202 may include at least one slide rail 1302(1) and 1302(2) extending between the top member 104 and the bottom member 114. A first end 1304 of the at least one slide rail 1302(1) may be attached to the top bracket 1208 and a second end 1306 of the at least one slide rail 1302(1) may be attached to the bottom member 114. Similarly, the first end 1304 of the at least one slide rail 1302(2) may be attached to the top bracket 1208 and the second end 1306 of the at least one slide rail 1302(2) may be attached to the bottom member 114. When the rack apparatus 1202 is displaced into the use position the bottom member 114 is linearly displaced a distance 1308 toward the top member 104 and when the rack apparatus 1202 is displaced into the stowed position the bottom member 114 is linearly displaced the distance 1308 away from the top member 104. The at least one slide rail 1302(1) and 1302(2) provide for linearly guiding the bottom member 114 along the distance 1308 when the rack apparatus 1202 is displaced between the stowed position and the use position. The rack apparatus 1202 may include one or more openings (not shown) disposed in a bottom member 1310. For example, the rack apparatus 1202 may include one or more openings (e.g., cutaways, notches, perforations, etc.) in the bottom member 1310 for hanging one or more hangers (not shown). For example, the rack apparatus 1202 may include one or more openings for hanging one or more hangers when the hangers and/or the rack apparatus 1202 are not being used to hang articles (e.g., clothing, safety gear, recreational equipment, etc.) on the hangers and/or the rack apparatus 1202.

Figure 14:
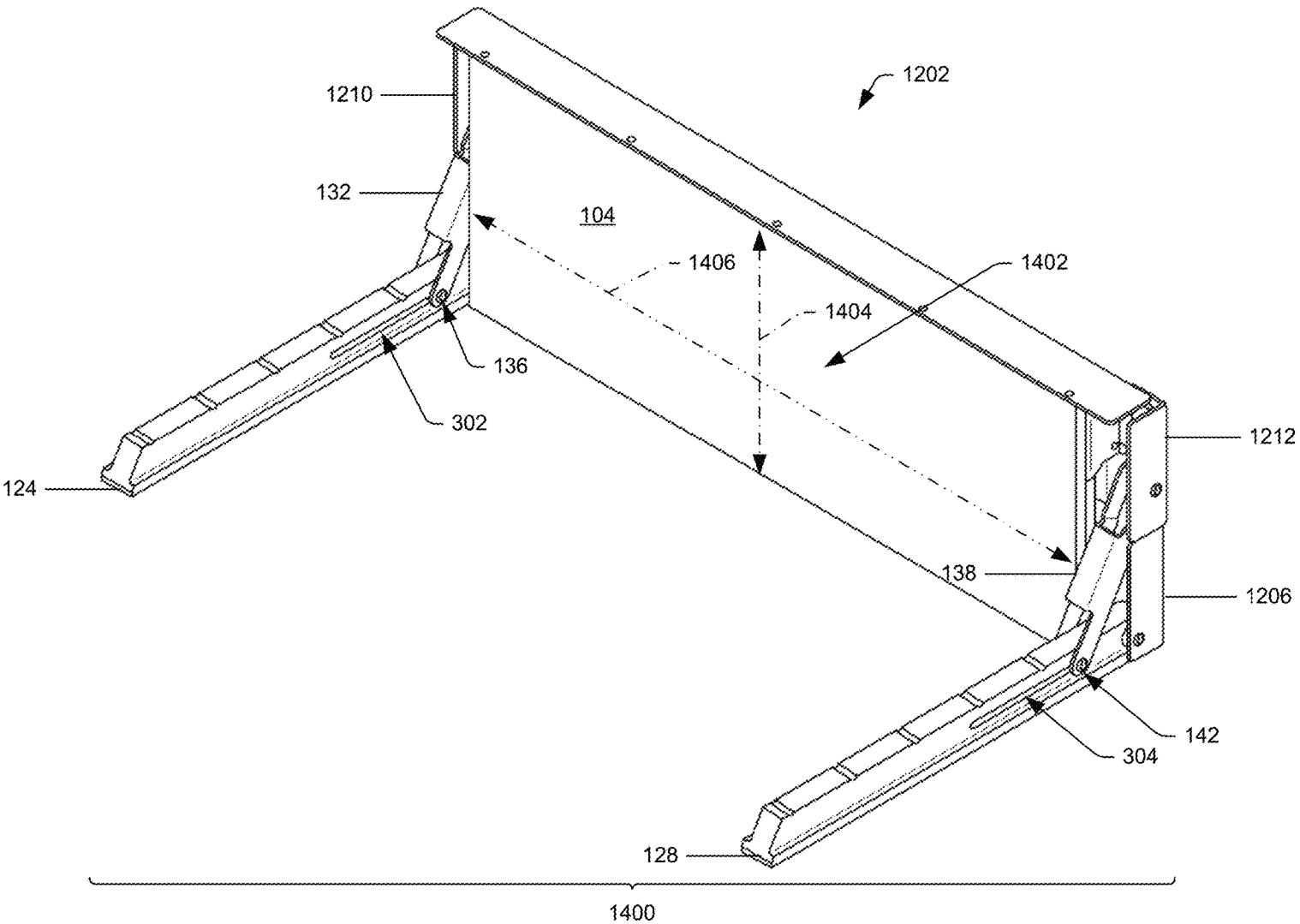
FIG. 14 illustrates a front perspective view of the other rack apparatus in a use position, according to an embodiment in this disclosure.

FIG. 14 illustrates a front perspective view 1400 of the rack apparatus 1202 in the use position, according to an embodiment in this disclosure. FIG. 14 illustrates that when the rack apparatus 1202 is in the use position, the first extension arm 124 extends at the angle away from the top member 104 and the second extension arm 128 extends at the angle away from the top member 104 for hanging at least one article of the one or more articles at the time of use. As discussed above, the second end 136 of the first linkage arm 132 may be slideably arranged in the slot 302 disposed in the first extension arm 124, and the second end 142 of the second linkage arm 138 may be slideably arranged in the slot 304 disposed in the second extension arm 128.

FIG. 14 illustrates the top member having a front surface 1402 in an x-y dimensional plane, where a width 1404 of the front surface 1402 defines the x dimensional direction and a length 1406 of the front surface 1404 defines the y dimensional direction.

FIG. 14 illustrates when the rack apparatus 1202 is displaced into the use position, the bottom member 114 is linearly displaced the distance 1308 toward the top member 104, the top member 104 is displaced in at least the x dimensional direction and a z dimensional direction perpendicular to the x dimensional direction and the y dimensional direction such that the front surface 1402 of the top member 104 covers the bottom member 114.

Figure 15:
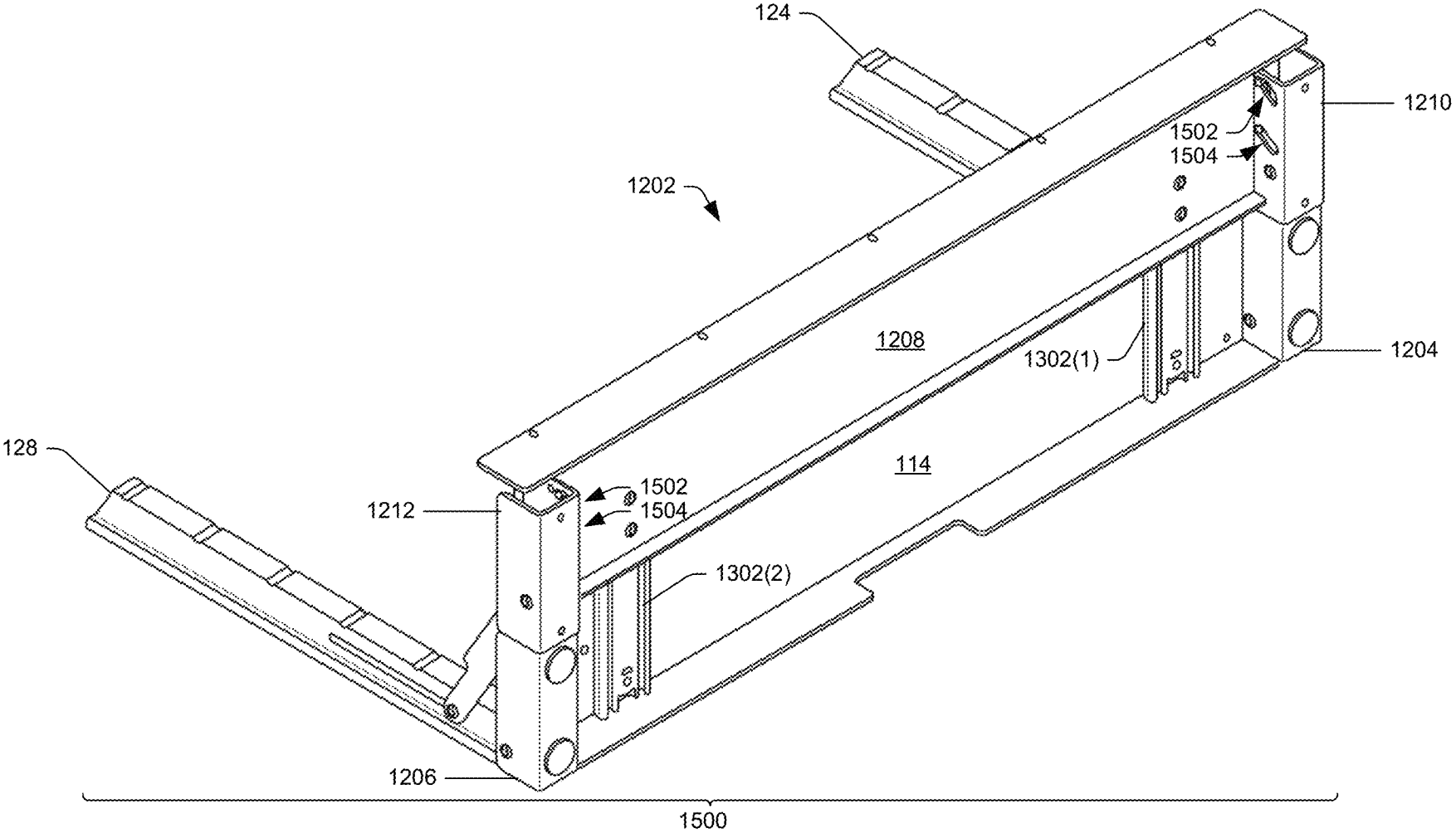
FIG. 15 illustrates a back perspective view of the other rack apparatus in a use position, according to an embodiment in this disclosure.

FIG. 15 illustrates a back perspective view 1500 of the rack apparatus 1202 in the use position, according to an embodiment in this disclosure. FIG. 15 illustrates a top track 1502 and a bottom track 1504 arranged in the first end 1210 of the top bracket 1208. Similarly, the top track 1502 and the bottom track 1504 may be arranged in the second end 1212 of the top bracket 1208. The first end 106 of the top member 104 may be moveably coupled to the top track 1502 and the bottom track 1504 arranged in the first end 1210 of the top bracket 1208 such that the first end 106 of the top member 104 is forced to curvilinearly displace along the top track 1502 and linearly displace along the bottom track 1504 arranged in the first end 1210 of the top bracket 1208. Similarly, the second end 108 of the top member 104 may be moveably coupled to the top track 1502 and the bottom track 1504 arranged in the second end 1212 of the top bracket 1208 such that the second end 108 of the top member 104 is also forced to curvilinearly displace along the top track 1502 and linearly displace along the bottom track 1504 arranged in the second end 1212 of the top bracket 1208. Because the top track 1502 and the bottom track 1504 force the first and second ends 106 and 108 of the top member 104 to curvilinearly displace and linearly displace respectively together, the top member 104 is forced to displace in the at least x dimensional direction and the z dimensional direction perpendicular to the x dimensional direction and the y dimensional direction such that the front surface 1402 of the top member 104 covers the bottom member 114 when the rack apparatus 1202 is displaced into the use position.

Figure 16:
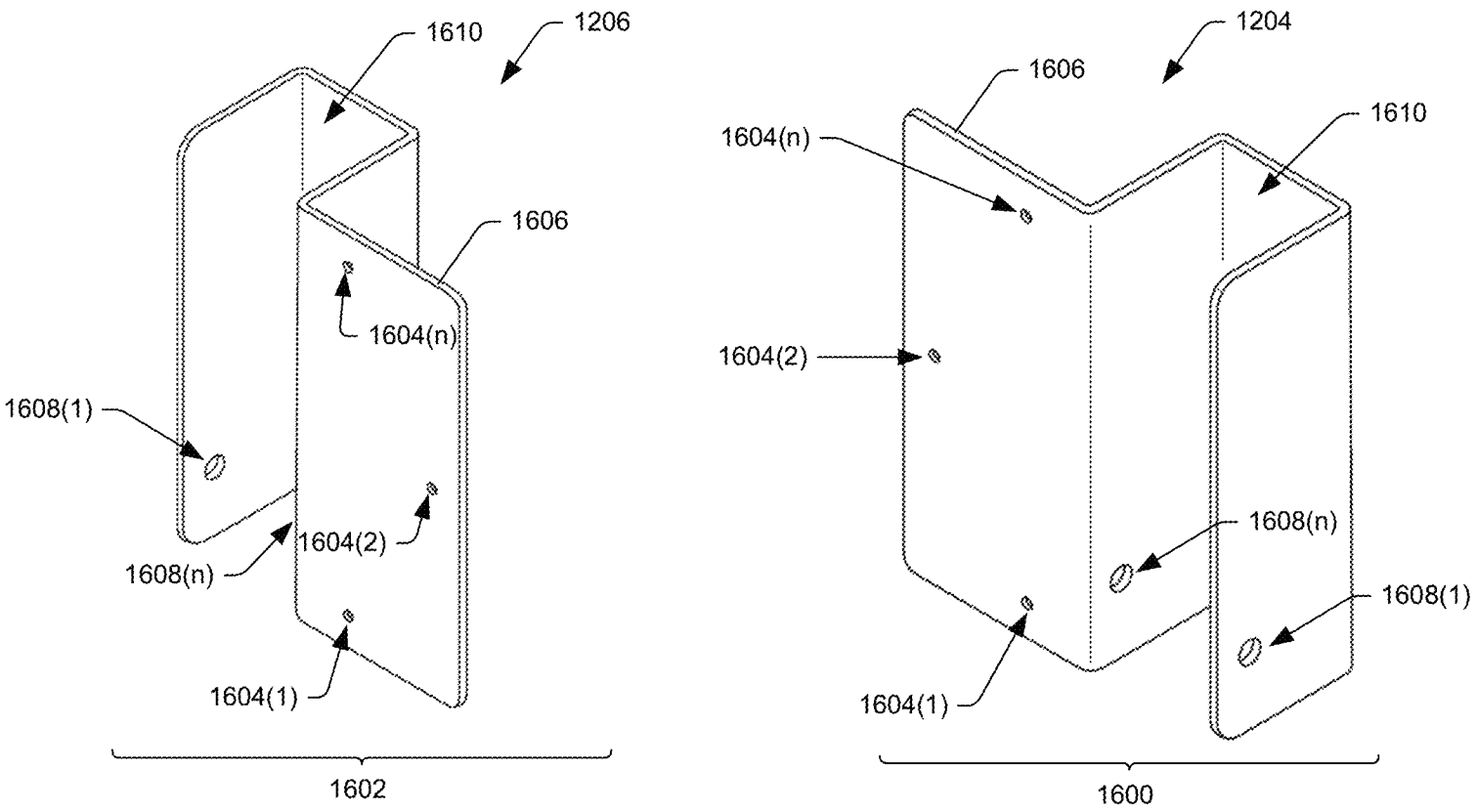
FIG. 16 illustrates a front perspective view of another first bottom end bracket and a front perspective view of another second bottom end bracket, according to an embodiment in this disclosure.

FIG. 16 illustrates a front perspective view 1600 of the first bottom end bracket 1204 and a front perspective view 1602 of the second bottom end bracket 1206, according to an embodiment in this disclosure. The first and second bottom end brackets 1204 and 1206 may include one or more through holes 1604(1), 1604(2), and 1604(*n*) disposed in a flange 1606 of each of the first and second bottom end brackets 1204 and 1206. The one or more through holes 1604(1), 1604(2), and 1604(*n*) providing for mounting the first and second bottom end brackets 1204 and 1206 to the bottom member 114. For example, fasteners (e.g., screws, rivets, bolts, etc.) may be received by the one or more through holes 1604(1), 1604(2), and 1604(*n*) and fixed into the bottom member 114.

The first and second bottom end brackets 1204 and 1206 may include one or more through holes 1608(1) and 1608(*n*) disposed in opposing walls of a channel 1610 of each of the first and second bottom end brackets 1204 and 1206. The one or more through holes 1608(1) and 1608(*n*) providing for pivotably attaching the first and second extension arms 124 and 128 to the first and second bottom end brackets 1204 and 1206. For example, the end 126 of the first extension arm 124 may be pivotably attached to the one or more through holes 1608(1) and 1608(*n*) of the first bottom end bracket 1204 via a fastener (e.g., screws, rivets, bolts, etc.). Similarly, the end 130 of the second extension arm 128 may be pivotably attached to the one or more through holes 1608(1) and 1608(*n*) of the second bottom end bracket 1206 via a fastener (e.g., screws, rivets, bolts, etc.).

Figure 17:
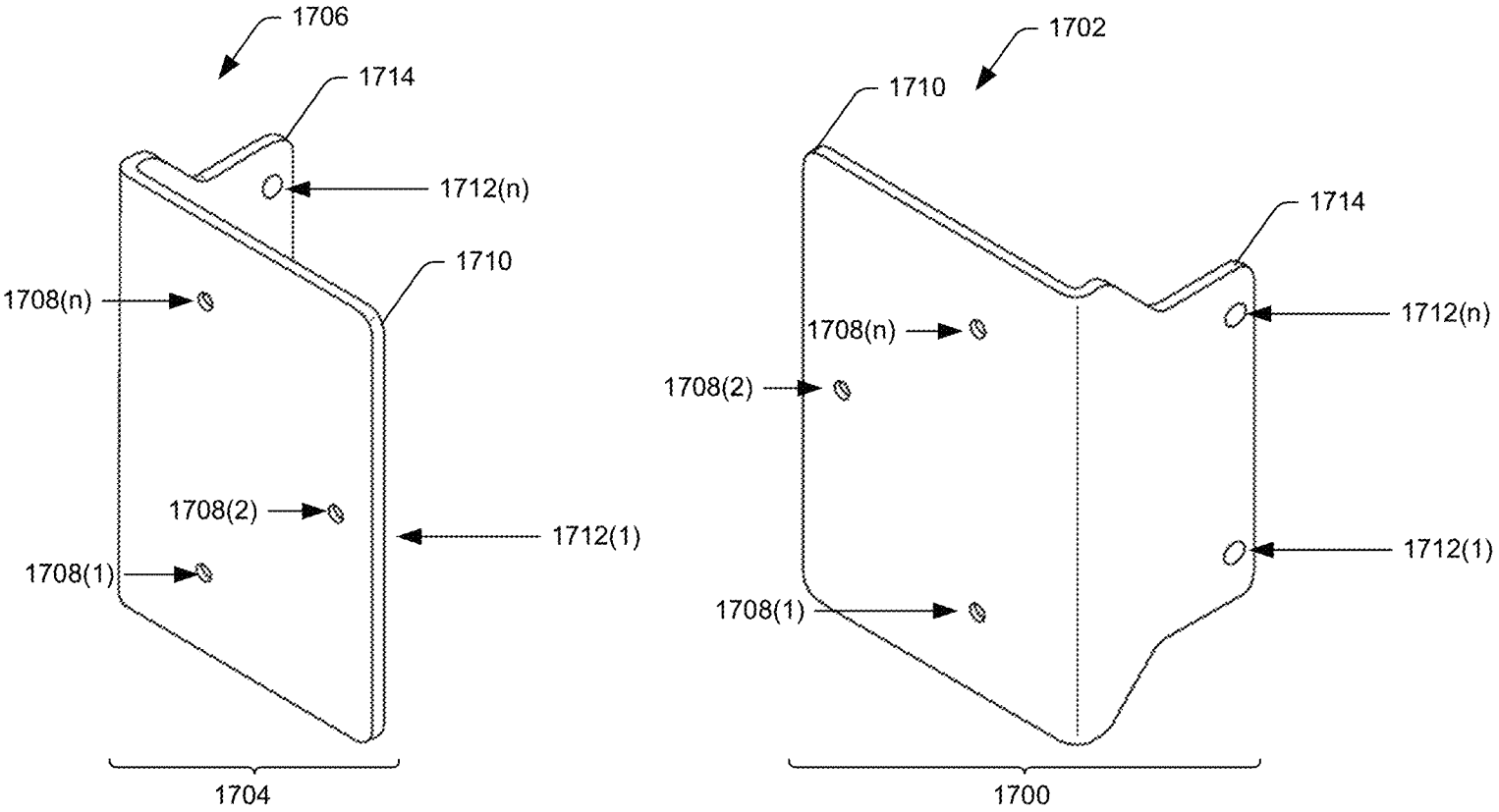
FIG. 17 illustrates a front perspective view of another first top end bracket and front perspective view of another second top end bracket, according to an embodiment in this disclosure.

FIG. 17 illustrates a front perspective view 1700 of a first top end bracket 1702 and a front perspective view 1704 of a second top end bracket 1706, according to an embodiment in this disclosure. The first and second top end brackets 1702 and 1706 may include one or more through holes 1708(1), 1708(2), and 1708(*n*) disposed in a first flange 1710 of each of the first and second top end brackets 1702 and 1706. The one or more through holes 1708(1), 1708(2), and 1708(*n*) providing for mounting the first and second top end brackets 1704 and 1706 to the top member 104. For example, fasteners (e.g., screws, rivets, bolts, etc.) may be received by the one or more through holes 1708(1), 1708(2), and 1708(*n*) and fixed into the top member 104.

The first and second top end brackets 1702 and 1706 may include one or more through holes 1712(1) and 1712(*n*) disposed in a second flange 1714 of each of the first and second top end brackets 1702 and 1706. The one or more through holes 1712(1) and 1712(*n*) providing for mounting the first and second top end brackets 1702 and 1706 to the top bracket 1208. For example, fasteners (e.g., screws, rivets, bolts, pins, etc.) may be received by the one or more through holes 1712(1) and 1712(*n*) and coupled to the top tracks 1502 and the bottom tracks 1504 arranged in the first and second ends 1210 and 1212 of the top bracket 1208.

Figure 18:
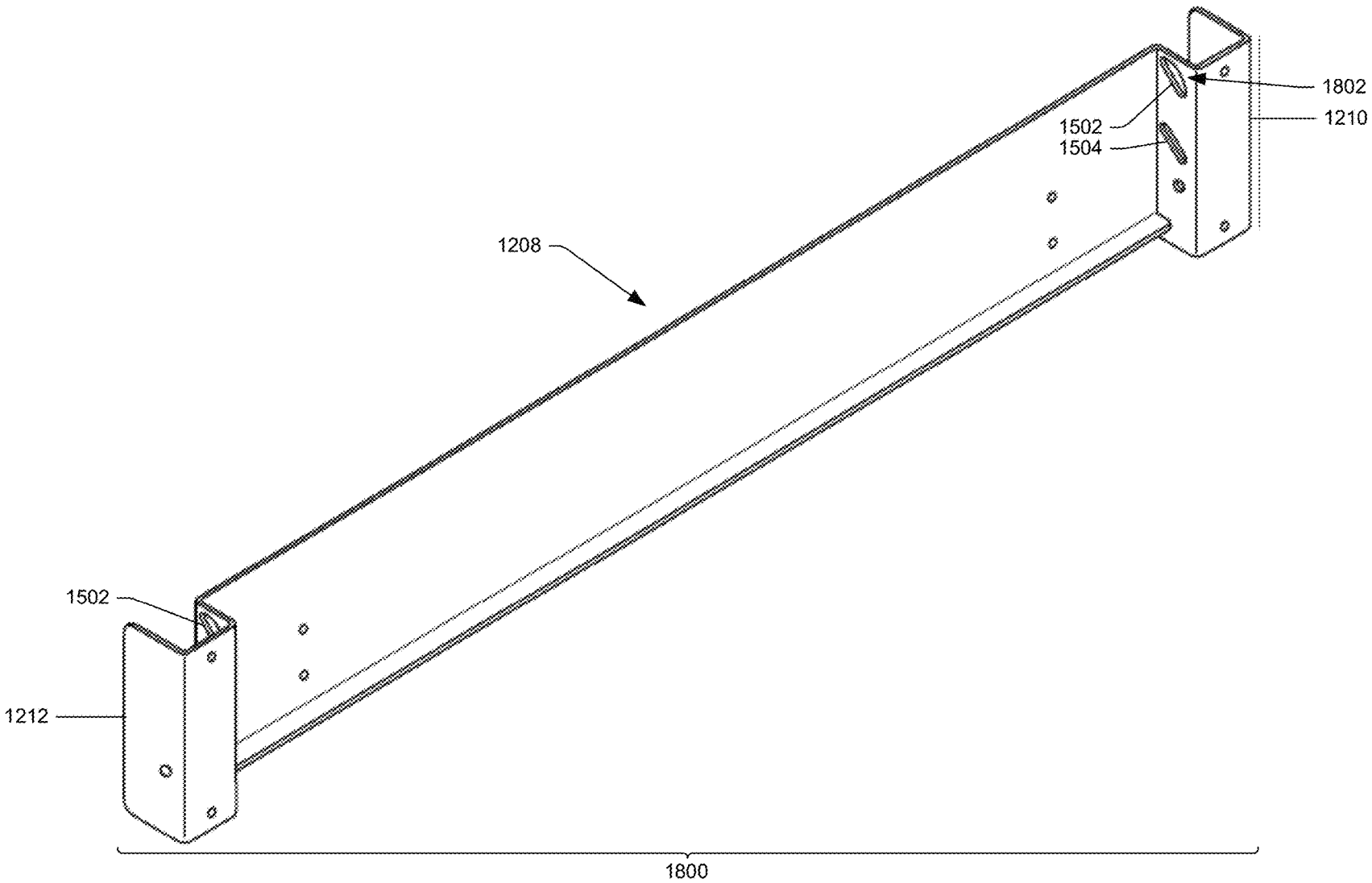
FIG. 18 illustrates a back perspective view a top bracket, according to an embodiment in this disclosure.

FIG. 18 illustrates a back perspective view 1800 of the top bracket 1208, according to an embodiment in this disclosure. FIG. 18 illustrates the top track 1502 disposed in the first and second ends 1210 and 1212 of the top bracket 1208. The top track 1502 may have an upward curve 1802 to force the top member 104 and/or the top and bottom brackets 1702 and 1706 in a path to prevent interference when being moved between the first position and the second position.

Figure 19:
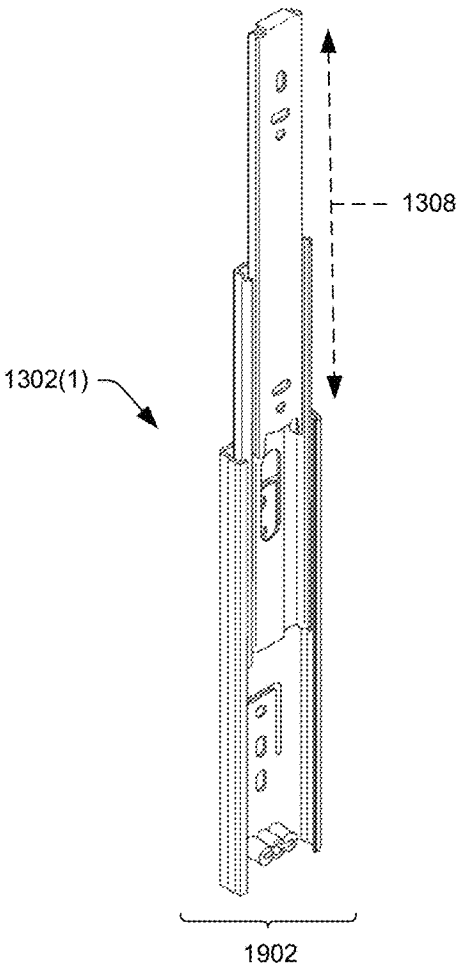
FIG. 19 illustrates a back perspective view of a slide rail in a non-extended position and a back perspective view of the slide rail in an extended position.
Figure 19:
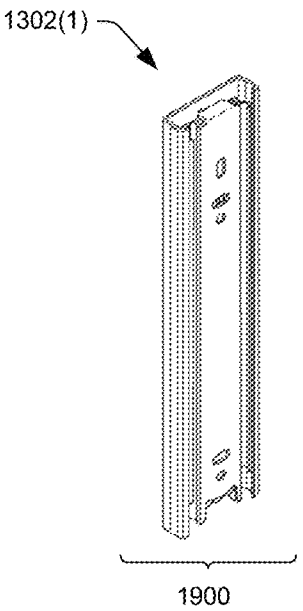

FIG. 19 illustrates a back perspective view 1900 of the at least one slide rail 1302(1) in a non-extended position and a back perspective view 1902 of the at least one slide rail 1302(1) in an extended position. As discussed above, the at least one slide rail 1302(1) provides for linearly guiding the bottom member 114 along the distance 1308 when the rack apparatus 1202 is displaced between the stowed position and the use position.

Figure 20:
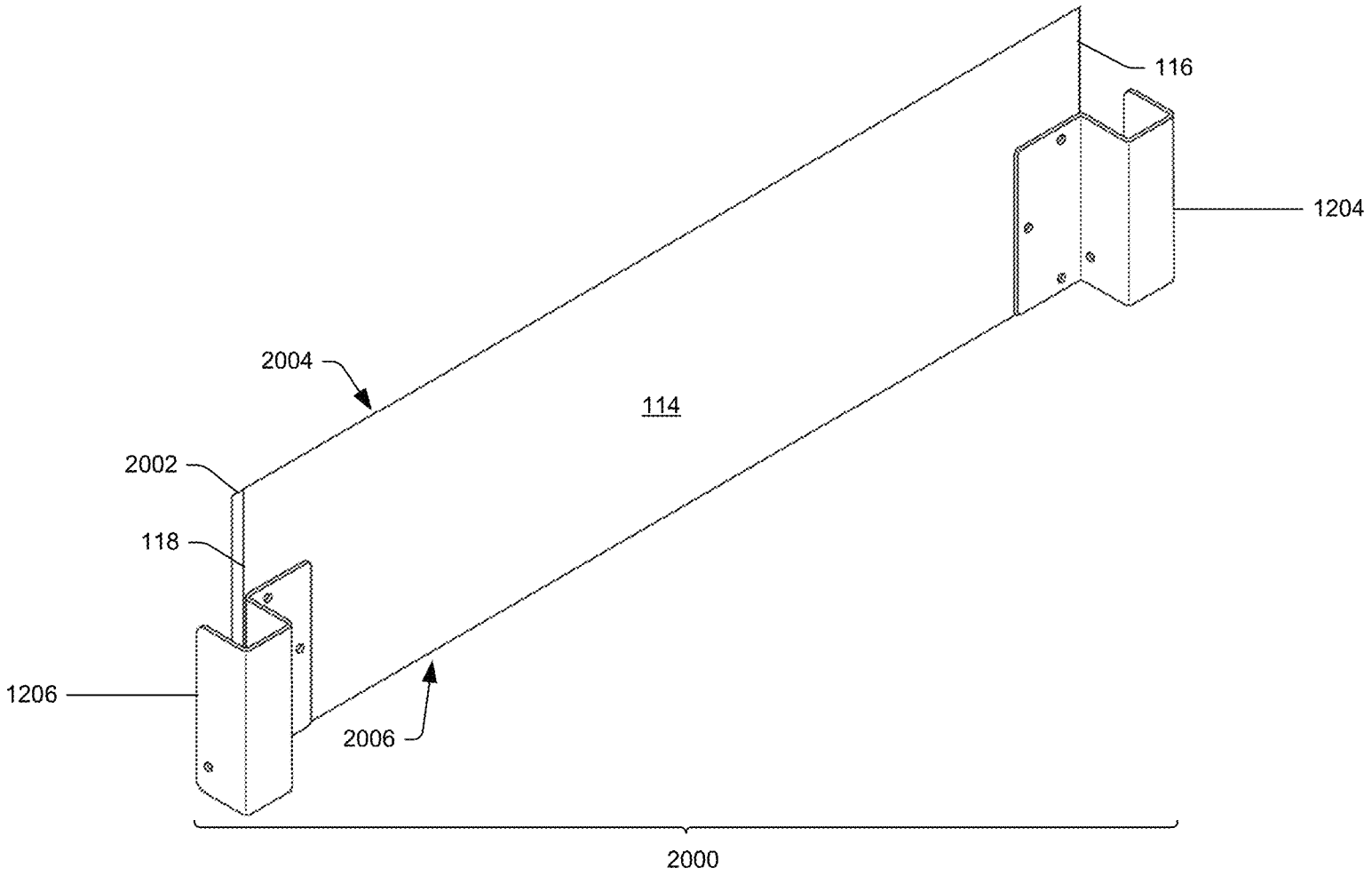
FIG. 20 illustrates a back perspective view of a bottom member, according to an embodiment in this disclosure.

FIG. 20 illustrates a back perspective view 2000 of the bottom member 114, according to an embodiment in this disclosure. FIG. 20 illustrates the first bottom end bracket 1204 attached to the first end 116 of the bottom member 114 and the second bottom end bracket 1206 attached to the second end 118 of the bottom member 114.

FIG. 20 illustrates a beveled edge 2002 arranged in a top portion 2004 of the bottom member 114 opposite a bottom portion 2006 of the bottom member 114. The beveled edge 2002 may extend along the top portion 2004 of the bottom member 114 between the first and second ends 116 and 118. The beveled edge 2002 may provide for making contact with an oppositely-oriented beveled edge arranged in a bottom portion of the top member (described in more detail below with respect to FIG. 21).

Figure 21:
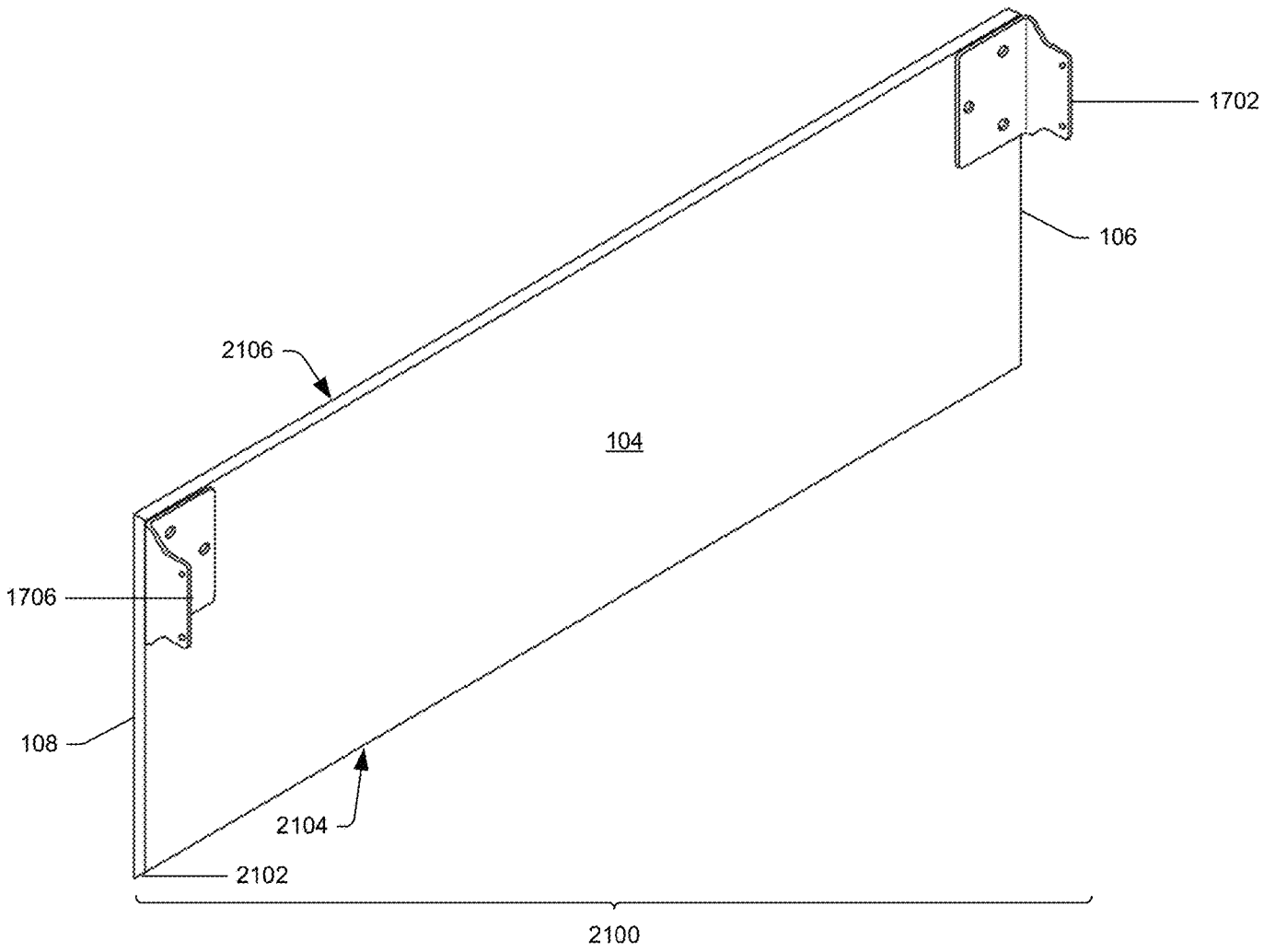
FIG. 21 illustrates a back perspective view of a top member, according to an embodiment in this disclosure.

FIG. 21 illustrates a back perspective view 2100 of the top member 104, according to an embodiment in this disclosure. FIG. 21 illustrates the first top end bracket 1702 attached to the first end 106 of the top member 104 and the second top end bracket 1706 attached to the second end 108 of the top member 104.

The first top end bracket 1702 attached to the first end 106 of the top member 104 may be moveably coupled to the top track 1502 and the bottom track 1504 arranged in the first end 1210 of the top bracket 1208 such that the first top end bracket 1702 is forced to curvilinearly displace along the top track 1502 and linearly displace along the bottom track 1504 arranged in the first end 1210 of the top bracket 1208. Similarly, the second top end bracket 1706 attached to the second end 108 of the top member 104 may be moveably coupled to the top track 1502 and the bottom track 1504 arranged in the second end 1212 of the top bracket 1208 such that the second top end bracket 1706 is also forced to curvilinearly displace along the top track 1502 and linearly displace along the bottom track 1504 arranged in the second end 1212 of the top bracket 1208. Because the top track 1502 and the bottom track 1504 force the first and second top end brackets 1702 and 1706 attached to the top member 104 to curvilinearly displace and linearly displace respectively together, the top member 104 is forced to displace in the at least x dimensional direction and the z dimensional direction perpendicular to the x dimensional direction and the y dimensional direction such that the front surface 1402 of the top member 104 covers the bottom member 114 when the rack apparatus 1202 is displaced into the use position.

FIG. 21 illustrates a beveled edge 2102 arranged in a bottom portion 2104 of the top member 104 opposite top portion 2106 of the top member 104. The beveled edge 2102 may extend along the bottom portion 2104 of the top member 104 between the first and second ends 106 and 108. The beveled edge 2102 may provide for making contact with the beveled edge 2002 arranged in the top portion 2004 of the top member 114. For example, the beveled edge 2002 arranged in the top portion 2004 of the bottom member 114 makes contact with the beveled edge 2102 arranged in the bottom portion 2104 of the top member 104 to initiate the displacement of the top member 104 in the at least the x dimensional direction and the z dimensional direction perpendicular to the x dimensional direction and the y dimensional direction such that the front surface 1402 of the top member 104 covers the bottom member 114 when the rack apparatus 1202 is displaced into the use position.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. A rack apparatus for hanging one or more articles, the rack apparatus comprising:

a top member extending between a first end of the top member opposite a second end of the top member;

a first top end bracket fixed to the first end of the top member;

a second top end bracket fixed to the second end of the top member;

a top bracket extending between a first end of the top bracket opposite a second end of the top bracket, the top bracket attachable to a vertical surface to fix the rack apparatus to the vertical surface, wherein the first top end bracket is moveably coupled to the first end of the top bracket and the second top end bracket is moveably coupled to the second end of the top bracket;

a bottom member extending between a first end of the bottom member opposite a second end of the bottom member;

a first bottom end bracket fixed to the first end of the bottom member;

a second bottom end bracket fixed to the second end of the bottom member;

a first extension arm having an end pivotably attached to the first bottom end bracket;

a second extension arm having an end pivotably attached to the second bottom end bracket;

a first linkage arm having a first end pivotably attached to the first end of the top bracket and a second end slideably attached to the first extension arm;

a second linkage arm having a first end pivotably attached to the second end of the top bracket and a second end slideably attached to the second extension arm; and wherein the rack apparatus is displaceable between a stowed position and a use position via linearly displacing the bottom member, such that when the rack apparatus is displaced into the use position the bottom member is linearly displaced a distance toward the top member and when the rack apparatus is displaced into the stowed position the bottom member is linearly displaced the distance away from the top member, wherein when in the stowed position, the first extension arm is positioned alongside the first end of the top member and alongside the first end of the bottom member, and the second extension arm is positioned alongside the second end of the top member and alongside the second end of the bottom member for storing the rack apparatus adjacent to the vertical surface until a time of use, and wherein when in the use position, the first extension arm extends at an angle away from the top member and the second extension arm extends at an angle away from the top member for hanging at least one article of the one or more articles at the time of use.

2. The rack apparatus of claim 1, further comprising at least one slide rail extending between the top member and the bottom member, wherein a first end of the at least one slide rail is attached to the top bracket and a second end of the at least one slide rail is attached to the bottom member, the at least one slide rail to linearly guide the bottom member along the distance when the rack apparatus is displaced between the stowed position and the use position.

3. The rack apparatus of claim 1, the top member having a front surface in an x-y dimensional plane, where a width of the front surface defines the x dimensional direction and a length of the front surface defines the y dimensional direction, and wherein when the rack apparatus is displaced into the use position, the bottom member is linearly displaced the distance toward the top member, the top member is displaced in at least the x dimensional direction and a z dimensional direction perpendicular to the x dimensional direction and the y dimensional direction such that the front surface of the top member covers the bottom member.

4. The rack apparatus of claim 3, the top bracket further including:

a top track and a bottom track arranged in the first end of the top bracket, a top track and a bottom track arranged in the second end of the top bracket, and wherein the first top end bracket is moveably coupled to the top track and the bottom track arranged in the first end of the top bracket such that the first top end bracket is forced to curvilinearly displace along the top track and linearly displace along the bottom track arranged in the first end of the top bracket and the second top end bracket is moveably coupled to the top track and the bottom track arranged in the second end of the top bracket such that the second top end bracket is forced to curvilinearly displace along the top track and linearly displace along the bottom track arranged in the second end of the top bracket to displace the top member in the at least x dimensional direction and the z dimensional direction perpendicular to the x dimensional direction and the y dimensional direction such that the front surface of the top member covers the bottom member when the rack apparatus is displaced into the use position.

5. The rack apparatus of claim 4, further comprising a beveled edge arranged in a top portion of the bottom member opposite a bottom portion of the bottom member for making contact with a beveled edge arranged in a bottom portion of the top member opposite a top portion of the top member, wherein the beveled edge arranged in the top portion of the bottom member makes contact with the beveled edge arranged in the bottom portion of the top member to displace the top member in the at least the x dimensional direction and the z dimensional direction perpendicular to the x dimensional direction and the y dimensional direction such that the front surface of the top member covers the bottom member when the rack apparatus is displaced into the use position.

6. A rack apparatus for hanging one or more articles, the rack apparatus comprising:

a top member extending between a first end of the top member opposite a second end of the top member, the top member having a front surface in an x-y dimensional plane, where a width of the front surface defines the x dimensional direction and a length of the front surface defines the y dimensional direction;

a bottom member extending between a first end of the bottom member opposite a second end of the bottom member;

a top bracket extending between a first end of the top bracket opposite a second end of the top bracket, the top bracket attachable to a vertical surface to fix the rack apparatus to the vertical surface;

a first extension arm having an end pivotably attached to the first end of the bottom member;

a second extension arm having an end pivotably attached to the second end of the bottom member;

a first linkage arm having a first end pivotably attached to the first end of the top bracket and a second end slideably attached to the first extension arm;

a second linkage arm having a first end pivotably attached to the second end of the top bracket and a second end slideably attached to the second extension arm; and wherein the rack apparatus is displaceable between a stowed position and a use position via linearly displacing the bottom member, wherein when the rack apparatus is displaced into the use position, the bottom member is linearly displaced a distance toward the top member, the top member is displaced in at least the x dimensional direction and a z dimensional direction perpendicular to the x dimensional direction and the y dimensional direction such that the front surface of the top member covers the bottom member, the first extension arm extends at an angle away from the bottom member and the second extension arm extends at an angle away from the bottom member for hanging at least one article of the one or more articles at a time of use, and wherein when the rack apparatus is displaced into the stowed position, the bottom member is linearly displaced the distance away from the top member, the top member is displaced in at least the x dimensional direction and the z dimensional direction perpendicular to the x dimensional direction and the y dimensional direction such that the front surface of the top member is coplanar to a front surface of the bottom member, the first extension arm is positioned alongside the first end of the top member and alongside the first end of the bottom member, and the second extension arm is positioned alongside the second end of the top member and alongside the second end of the bottom member for storing the rack apparatus adjacent to the vertical surface until the time of use.

7. The rack apparatus of claim 6, further comprising at least one slide rail extending between the top member and the bottom member, wherein a first end of the at least one slide rail is attached to the top bracket and a second end of the at least one slide rail is attached to the bottom member, the at least one slide rail to linearly guide the bottom member along the distance when the rack apparatus is displaced between the stowed position and the use position.

8. The rack apparatus of claim 6, the top bracket including:

a top track and a bottom track arranged in the first end of the top bracket, a top track and a bottom track arranged in the second end of the top bracket, and wherein the first end of the top member is moveably coupled to the top track and the bottom track arranged in the first end of the top bracket such that the first end of the top member is forced to curvilinearly displace along the top track and linearly displace along the bottom track arranged in the first end of the top bracket and the second end of the top member is moveably coupled to the top track and the bottom track arranged in the second end of the top bracket such that the second end of the top member is forced to curvilinearly displace along the top track and linearly displace along the bottom track arranged in the second end bracket, to displace the top member in the at least the x dimensional direction and the z dimensional direction perpendicular to the x dimensional direction and the y dimensional direction such that the front surface of the top member covers the bottom member when the rack apparatus is displaced into the use position.

9. The rack apparatus of claim 6, further comprising a beveled edge arranged in a top portion of the bottom member opposite a bottom portion of the bottom member for making contact with a beveled edge arranged in a bottom portion of the top member opposite a top portion of the top member, wherein the beveled edge arranged in the top portion of the bottom member makes contact with the beveled edge arranged in the bottom portion of the top member to displace the top member in the at least the x dimensional direction and the z dimensional direction perpendicular to the x dimensional direction and the y dimensional direction such that the front surface of the top member covers the bottom member when the rack apparatus is displaced into the use position.

10. The rack apparatus of claim 6, further comprising:

a first top end bracket fixed to the first end of the top member; and a second top end bracket fixed to the second end of the top member.

11. The rack apparatus of claim 10, wherein the first top end bracket is moveably coupled to the first end of the top bracket and the second top end bracket is moveably coupled to the second end of the top bracket.

12. The rack apparatus of claim 6, further comprising:

a first bottom end bracket fixed to the first end of the bottom member; and a second bottom end bracket fixed to the second end of the bottom member.

13. The rack apparatus of claim 12, wherein the end of the first extension arm is pivotably attached to the first bottom end bracket, and the end of the second extension arm is pivotably attached to the second bottom end bracket.

14. A rack apparatus for hanging one or more articles, the rack apparatus comprising:

a top member extending between a first end of the top member opposite a second end of the top member;

a bottom member extending between a first end of the bottom member opposite a second end of the bottom member;

a top bracket extending between a first end of the top bracket opposite a second end of the top bracket, the top bracket attachable to a vertical surface to fix the rack apparatus to the vertical surface;

a first extension arm having an end pivotably attached to the first end of the bottom member;

a second extension arm having an end pivotably attached to the second end of the bottom member;

a first linkage arm having a first end pivotably attached to the first end of the top bracket and a second end slideably attached to the first extension arm;

a second linkage arm having a first end pivotably attached to the second end of the top bracket and a second end slideably attached to the second extension arm; and wherein the rack apparatus is displaceable between a stowed position and a use position via linearly displacing the bottom member, such that when the rack apparatus is displaced into the use position the bottom member is linearly displaced a distance toward the top member and when the rack apparatus is displaced into the stowed position the bottom member is linearly displaced the distance away from the top member, wherein when in the stowed position, the first extension arm is positioned alongside the first end of the top member and alongside the first end of the bottom member, and the second extension arm is positioned alongside the second end of the top member and alongside the second end of the bottom member for storing the rack apparatus adjacent to the vertical surface until a time of use, and wherein when in the use position, the first extension arm extends at an angle away from the bottom member and the second extension arm extends at an angle away from the bottom member for hanging at least one article of the one or more articles at the time of use.

15. The rack apparatus of claim 14, further comprising at least one slide rail extending between the top member and the bottom member, wherein a first end of the at least one slide rail is attached to the top bracket and a second end of the at least one slide rail is attached to the bottom member, the at least one slide rail to linearly guide the bottom member along the distance when the rack apparatus is displaced between the stowed position and the use position.

16. The rack apparatus of claim 14, the top bracket including:

a top track and a bottom track arranged in the first end of the top bracket, a top track and a bottom track arranged in the second end of the top bracket, and wherein the first end of the top member is moveably coupled to the top track and the bottom track arranged in the first end of the top bracket such that the first end of the top member is forced to curvilinearly displace along the top track and linearly displace along the bottom track arranged in the first end of the top bracket and the second end of the top member is moveably coupled to the top track and the bottom track arranged in the second end of the top bracket such that the second end of the top member is forced to curvilinearly displace along the top track and linearly displace along the bottom track arranged in the second end bracket, to displace the top member such that a front surface of the top member covers the bottom member when the rack apparatus is displaced into the use position.

17. The rack apparatus of claim 14, further comprising:

a first top end bracket fixed to the first end of the top member; and a second top end bracket fixed to the second end of the top member.

18. The rack apparatus of claim 17, wherein the first top end bracket is moveably coupled to the first end of the top bracket and the second top end bracket is moveably coupled to the second end of the top bracket.

19. The rack apparatus of claim 17, further comprising:

a first bottom end bracket fixed to the first end of the bottom member; and a second bottom end bracket fixed to the second end of the bottom member.

20. The rack apparatus of claim 19, wherein the end of the first extension arm is pivotably attached to the first bottom end bracket, and the end of the second extension arm is pivotably attached to the second bottom end bracket.

* * * * *